US006447086B1

(12) United States Patent
Baker et al.

(10) Patent No.: US 6,447,086 B1
(45) Date of Patent: Sep. 10, 2002

(54) METHOD AND APPARATUS FOR ACHIEVING CONTROLLED RF SWITCHING RATIOS TO MAINTAIN THERMAL UNIFORMITY IN THE ACOUSTIC FOCAL SPOT OF AN ACOUSTIC INK PRINTHEAD

(75) Inventors: Lamar T. Baker, Manhattan Beach; Steven A. Buhler, Sunnyvale; Scott Elrod, La Honda; William F. Gunning, Los Altos Hills; Babur B. Hadimioglu, Mountain View; Abdul M. El Hatem, Redondo Beach; Joy Roy, San Jose; Richard Stearns, Los Gatos, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/449,038

(22) Filed: Nov. 24, 1999

(51) Int. Cl.[7] ..... B41J 29/38
(52) U.S. Cl. ..... 347/12
(58) Field of Search ..... 347/12, 5, 9, 67, 347/14, 66, 20, 46; 365/149; 340/870.13, 870.19, 825.26; 345/56; 367/105

(56) References Cited

U.S. PATENT DOCUMENTS

| | | | | |
|---|---|---|---|---|
| 3,727,185 A | * | 4/1973 | Jones et al. | 340/825.26 |
| 3,838,412 A | * | 9/1974 | Jones et al. | 340/870.3 |
| 4,235,111 A | * | 11/1980 | Hassler | 367/105 |
| 4,745,419 A | | 5/1988 | Quate et al. | |
| 4,751,530 A | | 6/1988 | Elrod et al. | |
| 4,782,350 A | | 11/1988 | Smith et al. | |
| 4,801,953 A | | 1/1989 | Quate | |
| 4,959,674 A | | 9/1990 | Khri-Yakub et al. | |
| 5,087,931 A | | 2/1992 | Rawson | |
| 5,121,141 A | | 6/1992 | Hadimioglu et al. | |
| 5,122,818 A | | 6/1992 | Elrod et al. | |
| 5,126,451 A | | 6/1992 | Rawson et al. | |
| 5,142,307 A | | 8/1992 | Elrod et al. | |
| 5,339,101 A | | 8/1994 | Rawson et al. | |
| 5,389,956 A | | 2/1995 | Hadimioglu et al. | |
| 5,450,107 A | | 9/1995 | Rawson | |
| 5,589,864 A | | 12/1996 | Hadimioglu | |
| 5,808,636 A | | 9/1998 | Stearns | |

FOREIGN PATENT DOCUMENTS

| | | |
|---|---|---|
| EP | 0 704 304 A | 4/1996 |
| EP | 0 953 451 A | 11/1999 |

* cited by examiner

*Primary Examiner*—John Barlow
*Assistant Examiner*—K. Feggins
(74) *Attorney, Agent, or Firm*—Fay, Sharpe, Fagan, Minnich & McKee, LLP

(57) ABSTRACT

A number of architectures of switch compensation networks are described for the provision of a compensation current which ensures the maintaining of a desired switching ratio in an acoustic printhead. The described architectures include those which provide column compensation, row compensation, and row and column compensation to a transducer switching matrix. Control of the switching ratio by the compensation networks, is used in consideration of the dissipation of heat energy through expulsion of a heated drop, to provide a precisely controlled balance.

23 Claims, 18 Drawing Sheets

METHOD AND APPARATUS FOR ACHIEVING CONTROLLED RF SWITCHING RATIOS TO MAINTAIN THERMAL UNIFORMITY IN THE ACOUSTIC FOCAL SPOT OF AN ACOUSTIC INK PRINTHEAD

BACKGROUND OF THE INVENTION

The present invention relates to acoustic printing, and more particularly to controlling the on/off switching ratio between ejectors of an acoustic printhead.

The fundamentals of acoustically ejecting droplets from an ejector device such as a printhead has been widely described, and the present assignee has obtained patents on numerous concepts related to this subject matter. In acoustic printing, an array of ejectors forming a printhead is covered by a pool of liquid. Each ejector can direct a beam of sound energy against a free surface of the liquid. The impinging acoustic beam exerts radiation pressure against the surface of the liquid. When the radiation pressure is sufficiently high, individual droplets of liquid are ejected from the pool surface to impact upon a medium, such as paper, to complete the printing process. The ejectors may be arranged in a matrix or array of rows and columns, where the rows stretch across the width of the recording medium, and the columns of ejectors are approximately perpendicular.

Ideally, each ejector when activated ejects a droplet identical in size to the droplets of all the other ejectors in the array. Thus, each ejector should operate under identical conditions.

In acoustic printing, the general practice is to address individual ejectors by applying a common RF pulse to a segment of a row, and to control the current flow to each ejector using column switches. In some cases it is desirable to use one column switch for several rows in parallel in order to reduce the number of column driver chips and wire bonds, and hence cost, in the system. Unfortunately, this approach results in parasitic current paths which can cause undesired RF current to flow through ejectors that are not in an ON state.

In existing systems, the switching ratio is limited and will vary with the number of ejectors that are ON in a given row. A switching ratio is defined as the RF power in an OFF ejector to the RF power in an ON ejector (i.e. $P_{OFF}/P_{ON}$).

FIG. 1 illustrates an acoustic switching array with a desired current path for a selected row and selected column for an existing system. Switching matrix 10 is a 4-row 12*a*, 12*b*, 12*c*, 12*d* by 64 column 14*a*, 14*b*, 14*zz* switching matrix. Rows are connected to the matrix via switching elements 16*a*, 16*b*, 16*c*, 16*d*, and columns are connected through switching elements 18*a*, 18*b*, 18*zz*. At the intersection of the columns and rows are transducers 20. Current paths of matrix 10 are terminated at RF ground 21. It is to be appreciated that while the matrix of FIG. 1 is a 4-row by 64-column matrix, the present invention may be used in other matrix designs.

Matrix 10 is supplied by a power source 22 which provides its output to an RF signal matching circuit or controller 24. By proper switch sequencing, a desired current path for a selected row and selected column is obtained. For example in FIG. 1, by closing switch 16*a* and switch 18*a*, a current path is provided from RF matching network 24 to a transducer 20*a* via row 12*a* and column 14*a*. As the remaining rows and columns are unselected, only transducer 20*a* is intended to be activated to emit a droplet.

Unfortunately, the interconnect paths used to implement a low cost acoustic printhead include unavoidable, undesirable current paths, as shown and discussed for example, in connection with FIGS. 2–4.

FIG. 2 is a simplified depiction of an undesired current path through an unselected transducer in the same row as a selected transducer. In this example, switches 16*a* and 18*a* are maintained in a closed position while the remaining switches are unselected. Therefore current is provided to transducer 20*a*. However, undesired current will also flow through transducer 20*b*, which is in selected row 12*a* but unselected column 14*b*. Similarly, FIG. 3 illustrates a situation where an undesired current flows through transducer 20*c*, which is in selected column 14a and unselected row 12*c*.

Column switches 18*a*–18*zz* are, in one embodiment, implemented with a component such as a PIN diode, which has a reasonably high intrinsic switching ratio, i.e., in the range of −6 dB or greater. A high switching ratio of this type may insure that a particular column switch is securely turned OFF if it were the only device in the system. However, a net switching ratio of a selected column and a selected row ejector (relative to other ejectors which should be OFF) can vary between approximately −2.3 dB and −6 dB, depending upon the number of existing parasitic current paths through ejectors which are not selected.

Turning to FIG. 4, a more detailed discussion is provided regarding the parasitic current paths introduced in connection with FIGS. 2 and 3. The transducers are identified by the row and column numbers to which they are connected. For the case illustrated, all current paths start from the conductor of row0, 12*a*, and terminate at RF ground return 21.

In the following example, transducer 20*b* is an unselected transducer. The undesired current through unselected transducer 20*b* consists of three components, all of which start from row0, 12*a*, and proceed down through transducer 20*b*. The first component flows from transducer 20*b*, down through the top segment of column1, 14*b*, up through transducer 20*d*, through a segment of row1, 12*b*, down through transducer 20*e*, down through column0, 14*a*, and finally through the selected column0 switch, 18*a*, to RF ground return 21.

The path of the second component is from row0, 12*a*, down through transducer 20*b*, and the top two segments of column1, 14*b*, up through transducer 20*f*, through a segment of row2, 12*c*, down through transducer 20*c*, down through column0, 14*a*, and finally through column0 switch, 18*a*, to RF ground return 21.

The path of the third component is from row0, 12*a*, down through transducer 20*b*, and the top three segments of column1, 14*b*, up through transducer 20*g*, through a segment of row3, 12*d*, down through transducer 20*h*, down through column0, 14*a*, and finally through column0 switch 18*a*, to RF ground return 21.

It is to be noted that no significant current is assumed to flow through any of the open (unselected) switches in columns 1 through 63 (14*b*–14*zz*), and rows 1, 2 or 3 (12*b*–12*d*).

Unwanted current paths, similar to those just described, also exist through other unselected transducers located on row0, 12*a*, and columns 2 through 63 (14*b*–14*zz*).

Transducers 20*e*, 20*c*, and 20*h* have the largest magnitude of total unwanted current. For example, the current flowing through the unselected transducer 20*e* is the sum of the currents in all the other transducers in row1, 12*b*. All of this unwanted current flows through the conducting path of unselected row1, 12*b*. In this example, transducers 20*e*, 20*c* and 20*h* are on a selected column and unselected rows. The switching ratio is the poorest for this category when only one column is selected. This may also be seen in FIGS. 6 and 7.

In the following description it is to be noted that FIGS. 5, 6, 9, 10, 15, 16 and 18 are block diagrams representing four categories of transducer states used in calculations of relative RF currents to determine the switching ratios for different numbers of selected columns.

For example, in FIG. 5 the block in the upper left part of the figure represents all of the transducers that are at Selected Row, Selected Column locations. Similarly, the block in the upper right part of the figure represents all of the transducers that are at Selected Row, Unselected Column locations. The block in the lower left part of the figure represents all of the transducers that are at Unselected Row, Selected column locations, and the block in the lower right part of the figure represents all of the transducers that are at Unselected Row, Unselected Column locations.

Turning more particularly to FIGS. 5 and 6, set forth are similar simplified depictions of switching matrix 10. FIG. 5 illustrates a situation where 63 columns 26, and one row 12*a* are selected, ON, and a single column 28 and remaining three rows 12*b*–12*d* are unselected, or OFF. Under this arrangement, the inventors have calculated that there is approximately 514 μA flowing through each of the 63 transducers 30, which represents the transducers in selected row 12*a*, and 63 ON columns 26 of matrix 10. It was also determined by this analysis that 393 μA of current will flow in transducer 32, located in selected row 12*a* and the 64th unselected column 28 of transducers. With this information, it is found that the switching ratio between these two currents is equal to:

$$393\ \mu A/514\ \mu A=0.765=-2.32\ dB.$$

FIG. 6 depicts an alternative arrangement where one column 34, and one row 12*a* are selected, and remaining 63 columns 36 and 3 rows 12*b*–12*d* are unselected. In this situation, the selected current path for transducer 38 has a current of 504 μA, whereas an unwanted current of approximately 368 μA exists through each of the unselected transducers connected to selected column 34 and unselected rows 12*b*–12*d*. This results in a switching ratio equal to:

$$368\ \mu A/504\ \mu A=0.730=-2.73\ dB.$$

The cumulative current through switch 18*a* is approximately 1607 μA (i.e. 504 μA from the selected transducer in column 34, row 12*a* and 368 μA from each of the three unselected transducers on column 34, on rows 12*b*–12*d*).

FIG. 7 summarizes the effective switching ratios relative to selected row/unselected columns, and selected columns/unselected rows as a function of the number of ejectors in the row which are ON. Particularly, curve 40 shows that as the number of selected columns increase, for an unselected row, the relative switching ratio improves substantially, i.e. approximately to −10 dB at 20 columns selected. Alternatively, curve 42 illustrates that for a selected row, as additional columns are moved to an ON state, the switching ratio is degraded substantially, i.e. from about −11 dB at one column ON, to about −2.5 dB for 63 columns ON.

When using aqueous inks for acoustic ink printing, the desired ejection velocity will be approximately 4 m/sec. This can be achieved using approximately 1 dB of power over the ejection threshold. Given that there are ejection threshold power non-uniformities in the aqueous printhead of approximately +/−0.5 dB, and the desire to maintain some margin of safety (e.g. −0.5 dB) to insure that ejectors which are unselected are truly OFF, an appropriate switching ratio may be found by the restrictions of: switching ratio (SR)< (overdrive for 4 m/sec)−(non-uniformity)−(margin to insure appropriate OFF state), which results in:

$$SR \leqq (-1-0.5-0.5)=-2\ dB.$$

Therefore, a switching ratio of −2.5 to −3.0 dB will be acceptable for printing of aqueous inks, when a −0.5 to −1.0 dB safety margin is added.

However, and more specifically related to the present invention, phase-change inks require more power over the threshold than aqueous inks. To achieve a necessary 4 m/sec ejection velocity, it has been determined that a −4 dB power over the threshold will be required. For phase-change inks, it is intended to use static E-fields to reduce this power requirement, however it is still necessary to eject the droplets at approximately 2 m/sec, i.e. −2 dB over threshold. Non-uniformities in the phase-change printhead can be larger than in aqueous printheads (i.e. +/−1 dB), and the margin for turning the switches fully OFF will also be similar (i.e. −0.5 dB). Therefore, the switching ratio for phase-change inks will require:

$$SR \leqq (-2\ -1\ -0.5)=-3.5\ dB.$$

Then, with a 0.5 to 1.0 dB safety margin added, a switching ratio of −4.0 to −4.5 dB is acceptable. Existing switching networks do not insure adequate switching ratio for phase-change printing when the foregoing requirements are taken into consideration.

A further complication which exists for phase-change printing, is that thermal uniformity requirements are more exacting than for aqueous printing because the acoustic losses in the ink are larger, and phase-change inks change more strongly with temperature than aqueous inks. As a result, a several degrees celsius change across the printhead, or between the ON and OFF states of a given ejector can result in spatial and time-varying non-uniformities which will degrade output. For example, a 1–2° C. change can result in a degradation in the drop diameter uniformity of 1–3%. It is believed the upper limit on drop diameter non-uniformity that can be tolerated for acceptable print quality is only 5%. Thus even comparatively small changes in temperature will cause printing degradation.

The foregoing problem is particularly acute for low flow printheads, i.e. printheads where the ink is not quickly passed through the printhead. In these situations, the acoustic energy will raise the temperature of the focal region above the bulk of the ink. In some printheads the temperature rise has been determined to be as much as 12° C. While this temperature rise can be used to an advantage (i.e. reducing the temperature requirement for the bulk volume of the ink in the printhead), it poses a problem of non-equal thermal environments for ejectors that are ON versus those that are OFF.

It has, therefore, been determined desirable to provide thermal environments for droplet ejector ON and OFF states which are essentially identical, by obtaining a specific switching ratio which balances the thermal changes associated with a hot ejected ink droplet. It is also considered beneficial to provide a controlled, specific switching ratio which is independent of the number of ejectors of any array which are ON and OFF.

Thus, it would be desirable to increase the switching ratio, and provide means to control the switching ratio at a desired level, independent of the number of ejectors which are ON.

SUMMARY OF THE INVENTION

Provided is a compensation circuit which can inject additional current into, or remove current from, a switching mechanism of a printhead to control the switching ratio. The additional compensation network allows for the maintaining of a precise switching ratio, independent of the number of ejectors in an ON state, in order to limit thermal non-uniformities in a printhead. The compensation design allows for a controlled adjustment of the switching ratio, and allows for control of the switching ratio at a desired level independent of the number of non-ejectors.

In a more limited aspect of the present invention, the compensation network is designed to take advantage of the design features of an acoustic ink printhead. In particular, since the configuration of the acoustic ink printhead results in up to 50% of heat energy at a focal spot being removed by ejection of a droplet, additional energy can be supplied such that a temperature balance is maintained between ejectors in an ON state and those in an OFF state.

DETAILED DESCRIPTION OF THE PREFERRED EMBODIMENTS

A general practice for controlling the emitters of an acoustic ink printer array is to address the individual ejectors by applying a common RF pulse to a segment of a row, and to control the current flow to each ejector using column switches. In existing systems, it may be preferable to use one column switch for several rows in parallel in order to reduce the number of column driver chips and wire bonds, and therefore cost, in the system matrix.

Unfortunately, this approach results in parasitic current paths which can limit the effective switching ratio, which can result in switching ratios that vary with the number of ejectors in an ON state in a given row. For phase change acoustic ink printing, there is a need for switching ratios better than the typical −2 to −3 dB minimum that can be achieved with ganged 4-row column switches.

Therefore, the present invention describes a scheme and accompanying architectures which are able to maintain a precise switching ratio, independent of the number of ejectors ON, in order to limit thermal non-uniformities in printheads.

Figure 8:
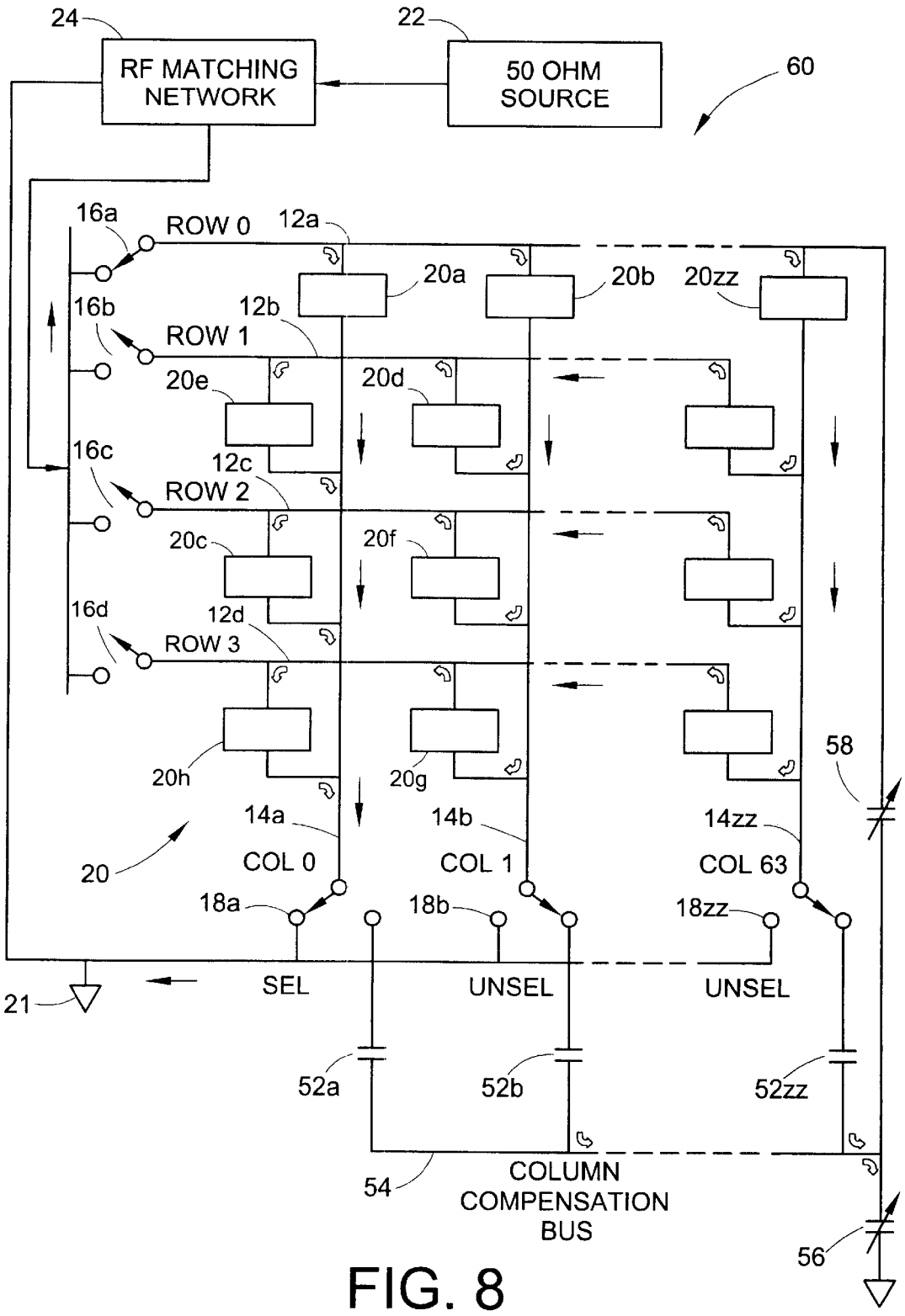
FIG. 8 shows a detailed illustration of a switching network to improve a switching ratio.

FIG. 8 illustrates a transducer matrix 60, to assist in the description of the concept of providing a compensating current path to the column nodes of the transducer matrix as used in acoustic printheads Providing compensation results in a smaller amount of undesirable current flow, allowing for an improvement in the switching ratio which has been defined as the ratio of the undesired RF power in an OFF ejector to the RF power in an ejector that is in an ON state (i.e. $P_{OFF}/P_{ON}$).

Figure 4:
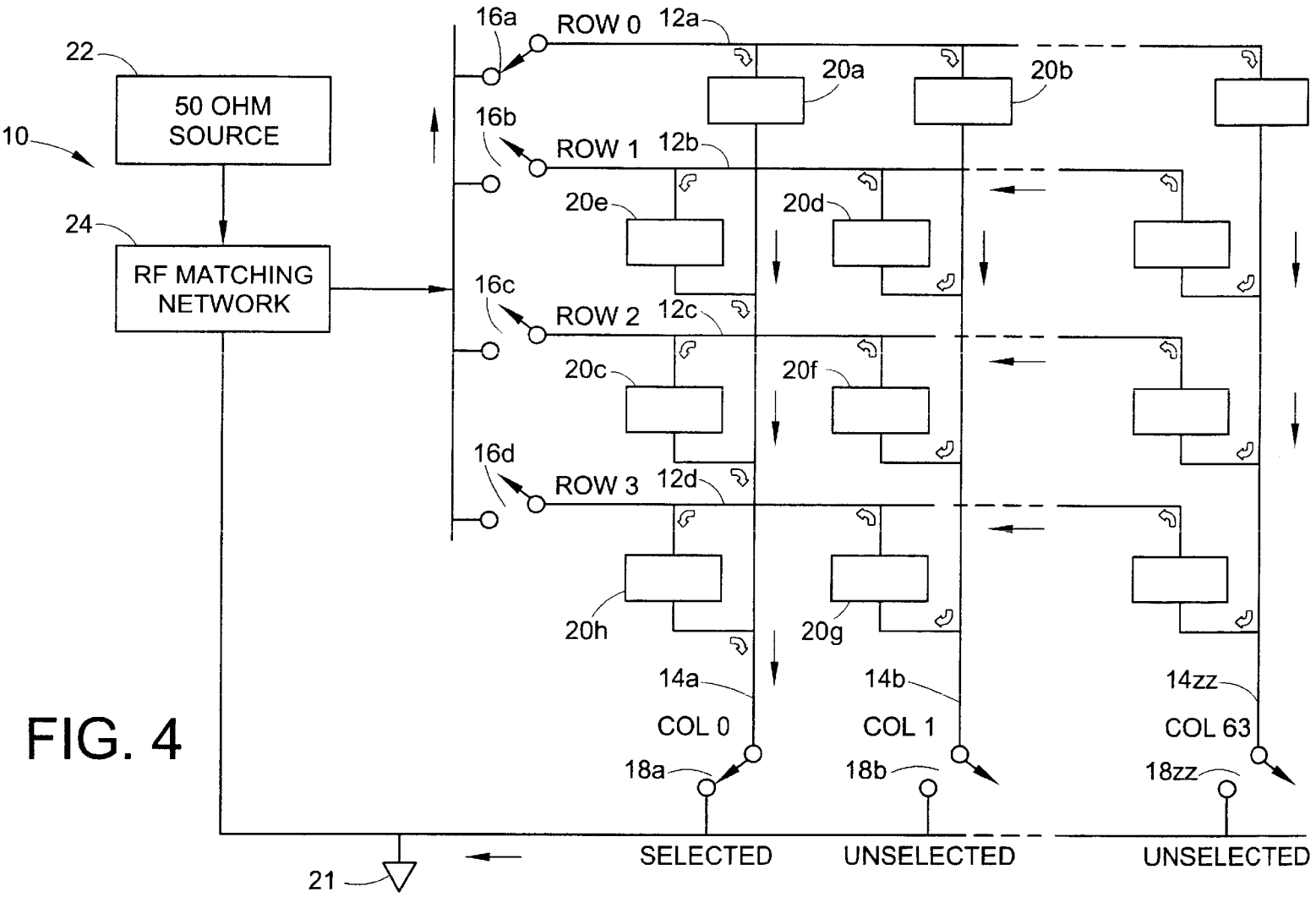
FIG. 4 sets forth a detailed illustration of undesired current paths in a switching matrix.
Figure 5:
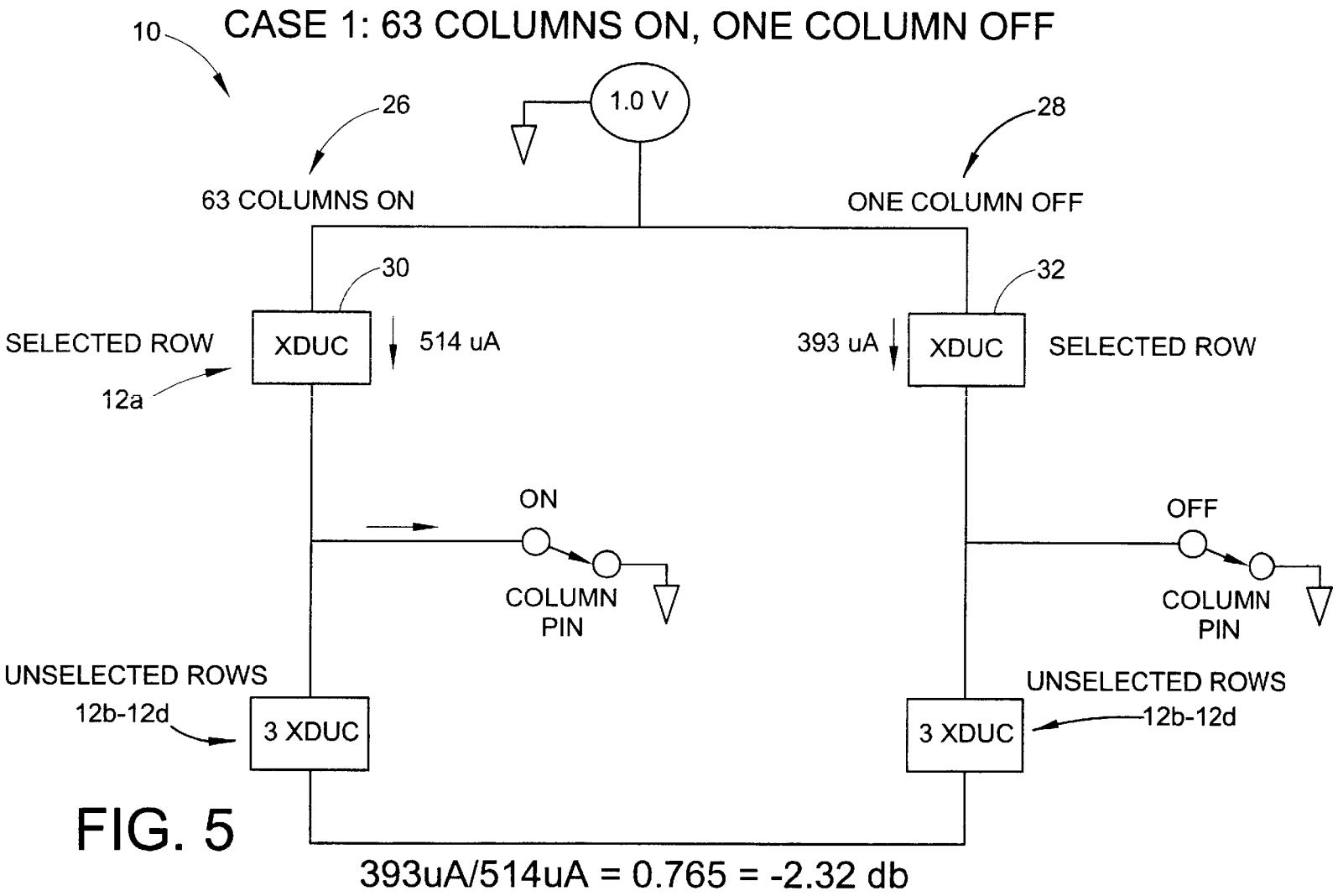
FIG. 5 depicts the simplified model of FIG. 1 wherein a single row is selected and 63 columns are selected.
Figure 6:
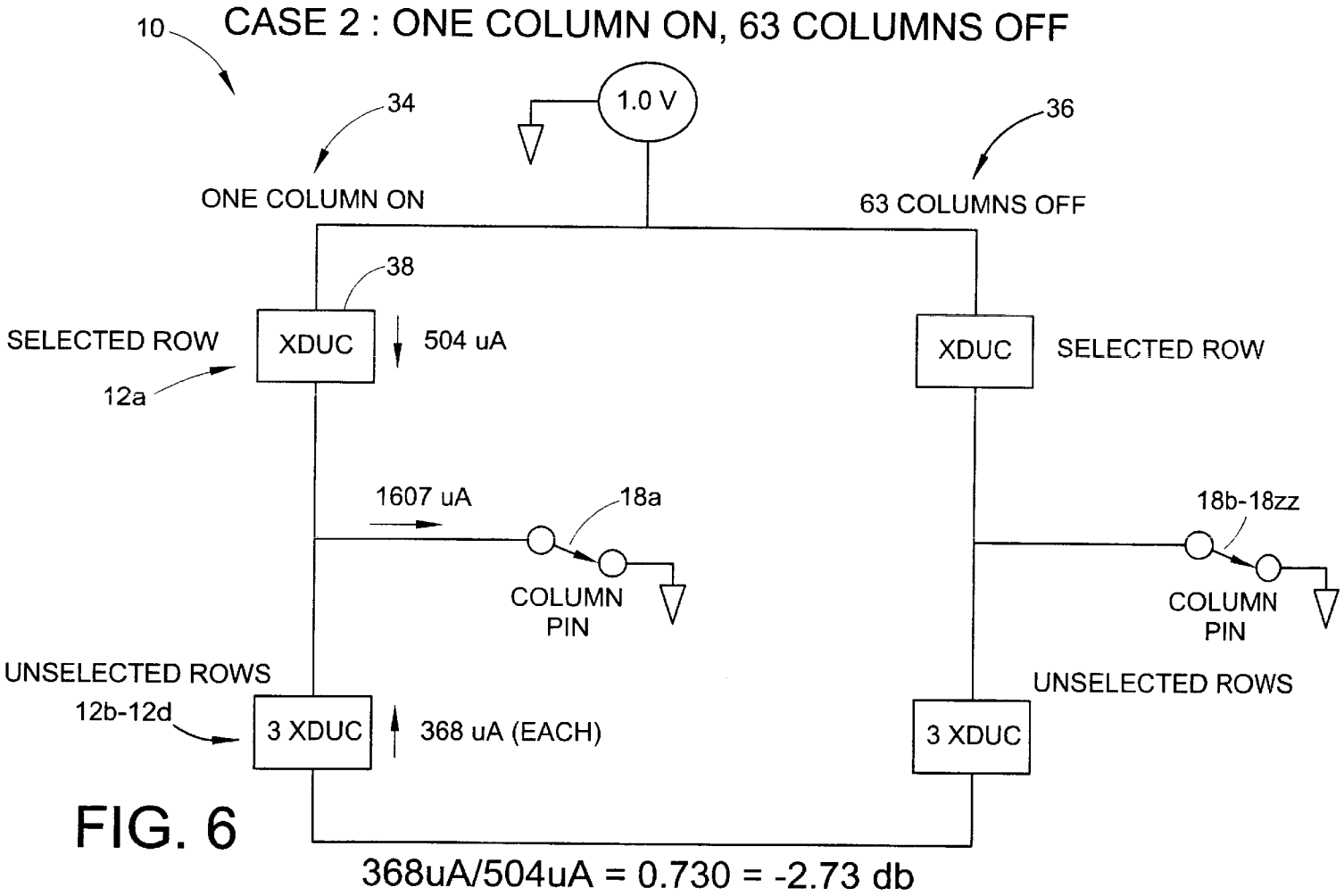
FIG. 6 illustrates the matrix of FIG. 1 wherein a single row and single column are selected.
Figure 7:
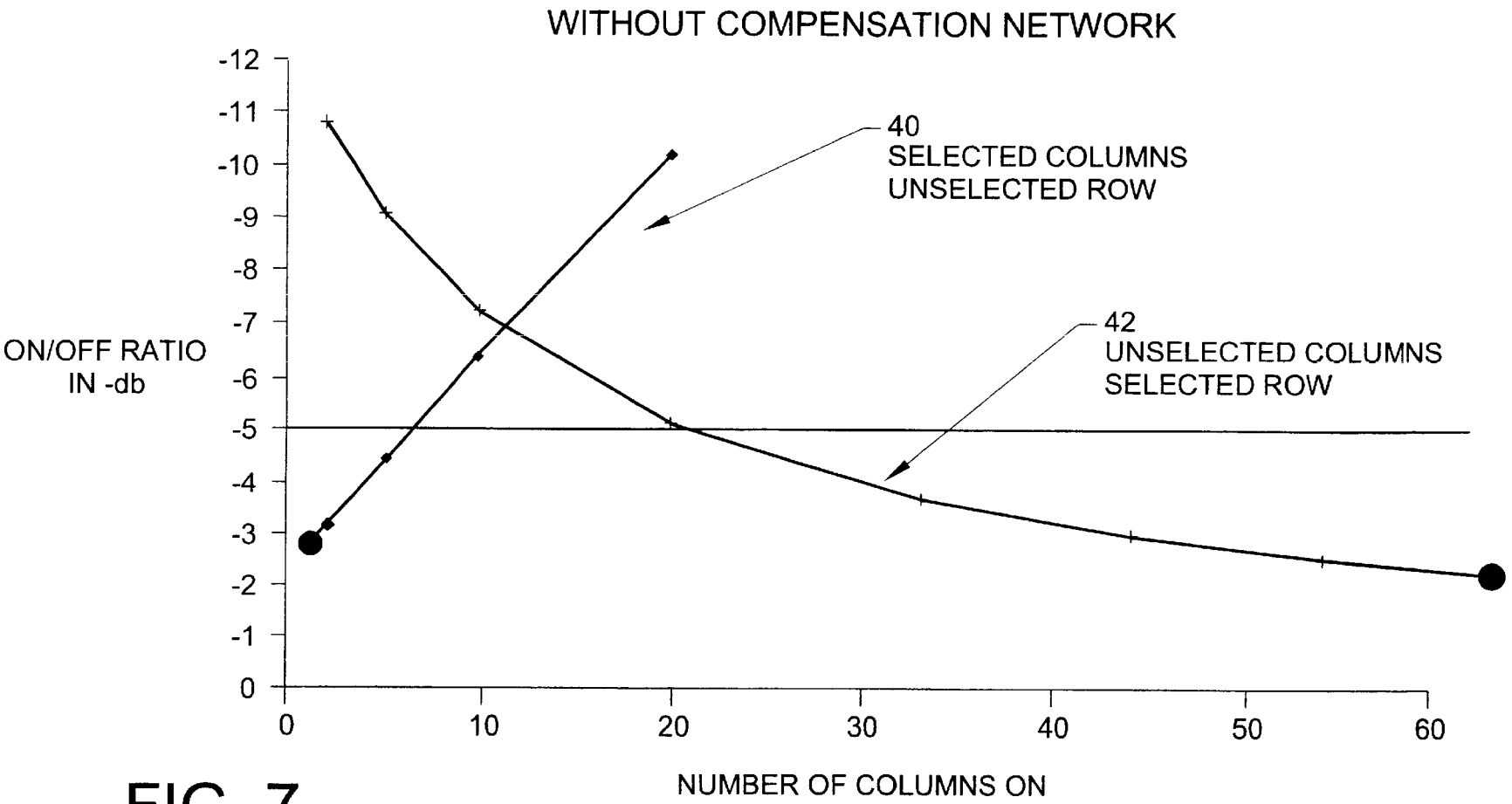
FIG. 7 depicts a graphical representation of a switching ratio dependent upon the number of selected columns.

The 4 row by 64 column transducer array 60 depicted in FIG. 8 is substantially similar in part to the configuration shown in FIGS. 4–6. In the following discussion, it is assumed column0, 14*a*, is selected, and all other columns are not selected. In this example, the troublesome current paths are those that flow through unselected transducers 20*e*, 20*c* and 20*h*, where the switching ratio is −2.73 dB, as calculated in FIG. 6. These currents originate on selected row0, 12*a*, and flow through unselected transducers 20*b*–20*zz*, to the unselected column conductors, for columns 14*b* through 14*zz*. The unwanted currents then flow from the unselected columns, through three groups of transducers to the three unselected row conductors. The path is completed through transducers 20*e*, 20*c* and 20*h* and the selected column0, 14*a*, column conductor and column switch 18*a*, to a ground return 21. The switching ratio for transducers 20*e*, 20*c* and 20*h* can be improved to be better than −5 dB by adding a compensation current path from the unselected column conductors to ground return 21.

One way to accomplish this is shown in FIG. 8. The column switches (18*a*–18*zz*) are changed from Single-Pole-Single-Throw to Single-Pole-Double-Throw. Small value compensation capacitors (e.g. 1 pF) (52*a*–52*zz*), connect the new normally closed contact on each column switch to a column compensation bus 54. The column compensation bus 54 extracts current from each of the unselected column conductors and passes it to ground return 21, through a variable pull down capacitor 56.

The formed compensation current path will carry some of the current that would, in the absence of the compensation path, flow through the transducers 20*e*, 20*c*, 20*h* in the Selected-Column, Unselected-Row category, thereby reducing the magnitude of the unwanted current and improving the switching ratio. For this example, the value of a pull-up capacitor 58 is very small so only a negligible current will flow through it to the column compensation bus 54.

The uncompensated switching ratio for the 1 column off, 63 columns selected case is −2.32 dB as shown in FIG. 5. When the compensation path from selected row0, through pull-up capacitor 58 to the column compensation bus 54 is added (as depicted in FIG. 8), the compensation path is able to carry some of the unwanted current that would otherwise flow through the Selected-Row, Unselected-Column transducer such that the switching ratio is improved to −5.67 dB, as shown in FIG. 9.

Figure 9:
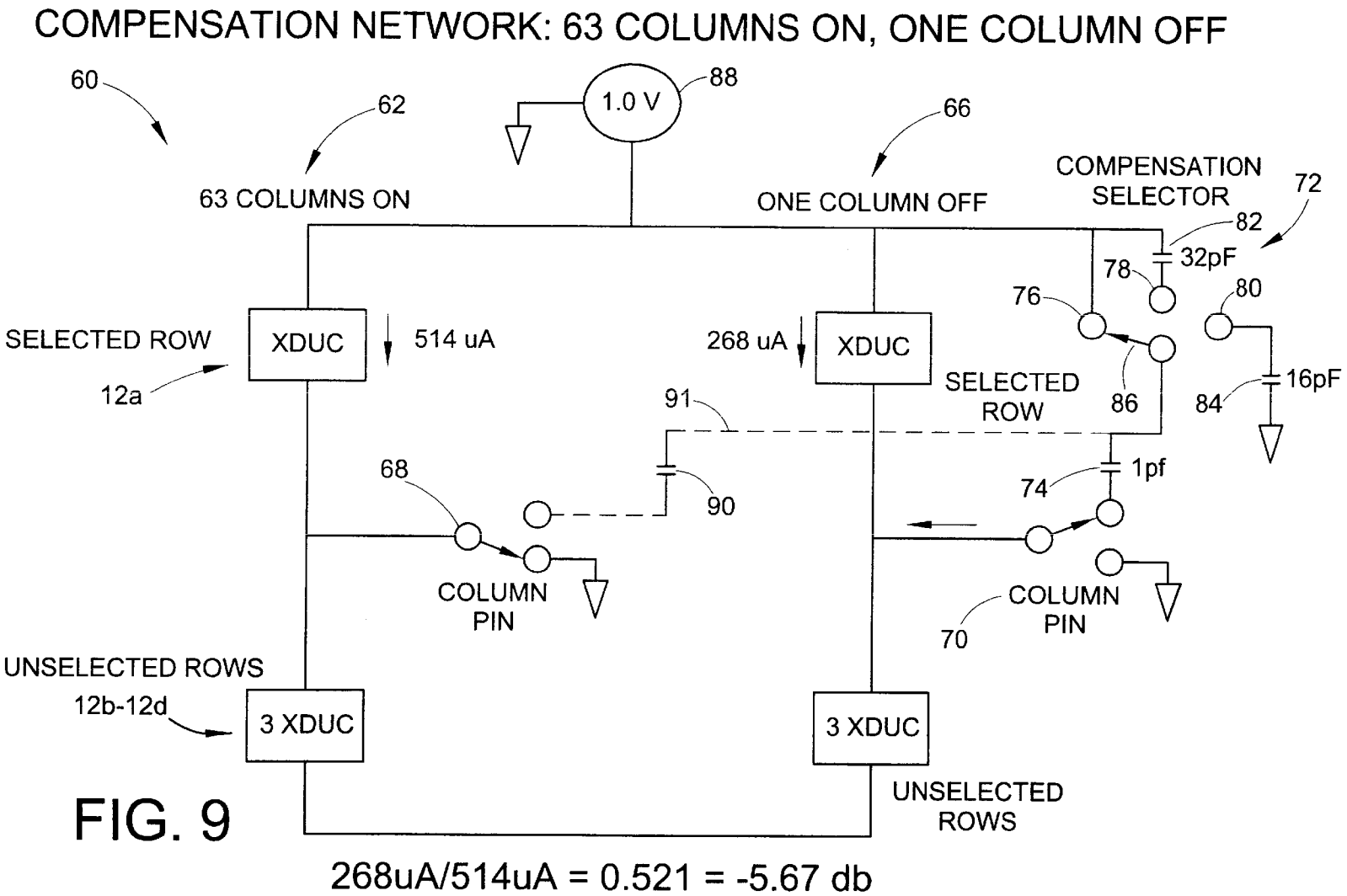
FIG. 9 provides a simplified schematic of the switching network of FIG. 1 including a compensation scheme to increase the switching ratio.

FIG. 9 depicts a simplified version of a switching matrix 60 having 4 rows and 64 columns. In this example, switching matrix 60 has 63 selected columns 62, and a single selected row 12*a*. This circuit also depicts a single unselected column 66 and 3 unselected rows 12*b*–12*d*. A column switch 68 is in a selected position, which corresponds to the selection of the 63 columns 62. Column switch 70 is in an unselected state.

With particular attention to the concepts of the present invention, a compensation selection circuit 72 is provided which includes a first capacitor 74, which in this embodiment may be a 1 pico-farad capacitor, and switching terminals 76, 78 and 80. Terminal 78 has included therein a 32 pico-farad compensation capacitor 82, and terminal 80 has a 16 picofarad compensation capacitor 84. In this initial representation, when a compensation selector switch 86 is connected to terminal 76, a connection is made from RF source 88 through capacitor 74 to switch 70. Similar to the discussion in connection with the switching network of FIG. 8, this arrangement depicts an arrangement to provide a compensating current path to the column nodes of a transducer matrix used in acoustic printheads. Also, in FIG. 8 choosing a large value capacitor, as the pull-up capacitor 58, results in operational characteristics corresponding to having compensation selector switch 86, connected to switching terminal 76.

By providing compensating current paths , it is possible to improve and stabilize the effective switching ratio for a number of ejectors irrespective of those which are ON or OFF. FIG. 9 illustrates a case where 63 ejectors are ON and one OFF, in which the switching ratio relative to the Selected Row/Unselected Column category has been increased. Specifically, transducers in the selected columns have 514 $\mu$A and the transducer in the unselected column has 268 $\mu$A. Therefore, the switching ratio is:

$$268\ \mu A / 514\ \mu A = 0.521 = -5.67\ dB.$$

It is noted that compensation capacitor 90 is provided for connection to columns 1–63. It is to be appreciated that compensation capacitor 90 represents a network of compensation capacitors such that each column has appropriate capacitive values. Further, a column compensation bus 91, similar to column compensation bus 54 of FIG. 8, is provided between compensation capacitor 90 and compensation selector switch 86. Capacitors 74 and 90 provide current paths from the column compensation bus 91 to individual column switches, such as switch 70.

Figure 10:
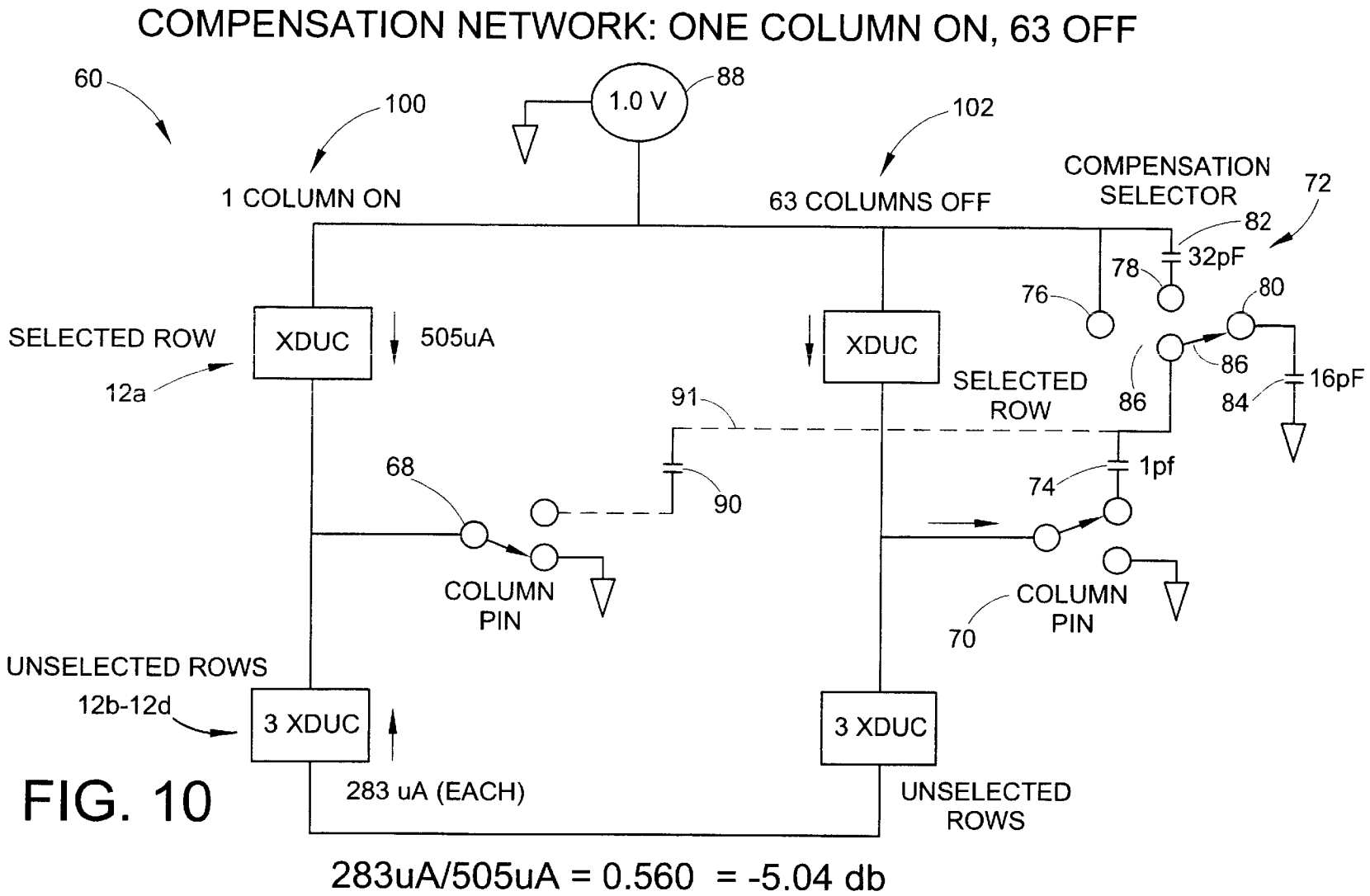
FIG. 10 depicts the simplified schematic of FIG. 9 in a case where 63 ejectors are in an OFF state and a single ejector is in an ON state.

To further describe the foregoing concept, illustrated in FIGURE 10 is matrix configuration 60 of FIG. 9 which shows an alternative view of the case dealt with in connection with FIG. 8. In this example, a single column is selected 100 and 63 columns are unselected 102. Further, a single row is selected 12*a* and three rows of the matrix are unselected 12*b*–12*d*. Compensation selection network 72 is shown with compensation selector 86 connected to terminal 80, which includes compensation capacitor 84 coupled to ground. In this example, the switching ratio is:

$$283\ \mu A / 505\ \mu A = 0.560 = -5.04\ dB.$$

Thus, whereas the switching network 10 of FIG. 5 (which includes 63 selected columns and one selected row) has a switching ratio of −2.32 dB, the addition and use of compensation selection network 72 of FIG. 9 is able to improve this switching ratio to −5.67 dB. Similarly, whereas the switching network of FIG. 6 (which includes one selected column and one selected row) has a switching ratio of −2.73 dB, compensation selection network 72 of FIG. 10 improves its switching ratio to −5.04 dB. The foregoing discussion illustrates the addition of a compensation selection network 72 allows for an improvement in the switching ratio for ejectors of an acoustic ink printer.

It may be desirable to not only maintain the switching ratio above a certain value but also within a certain range, as the number of columns which are selected increase. In this regard, attention is drawn to FIG. 11, which shows the switching ratio characteristics of the compensation selection network 72 for a matrix 60 as shown in the forgoing figures. Curve 110 depicts a switching ratio achievable when compensation selector switch 86 is connected to terminal 80. In this configuration, switch 70 is compensated by capacitive coupling to ground, through capacitors 74 and 84. As the number of selected columns increase, the switching ratio first improves from approximately −5 dB to a best value of approximately −6 dB, and then begins to degrade below a −5 dB switching ratio. Curve 112 shows the characteristics of operation when compensation selector 86 is connected to terminal 78, whereby the compensation current is provided from the RF switch source 88 through coupling capacitor 82 and capacitor 74. Curve 112 shows an improvement in the switching ratio from approximately 10 columns ON to approximately 20 columns ON, and thereafter an inferior ON/OFF ratio in decibels, as additional columns are selected. Lastly, curve 114 illustrates the switching ratio characteristics when compensation selector switch 86 is connected to terminal 76 such that the RF source 88 is directly connected to the column compensation bus 91. While the switching ratio under this connection scheme is good at a lower number of selected columns, as the number of selected columns increase the switching ratio degrades. Additionally, as previously mentioned, selection of a large value capacitor as pull-up capacitor 58, in FIG. 8, results in the same operational characteristics obtained by having compensation selector switch 86 connected to switching terminal 76 of FIG. 9.

Figure 1:
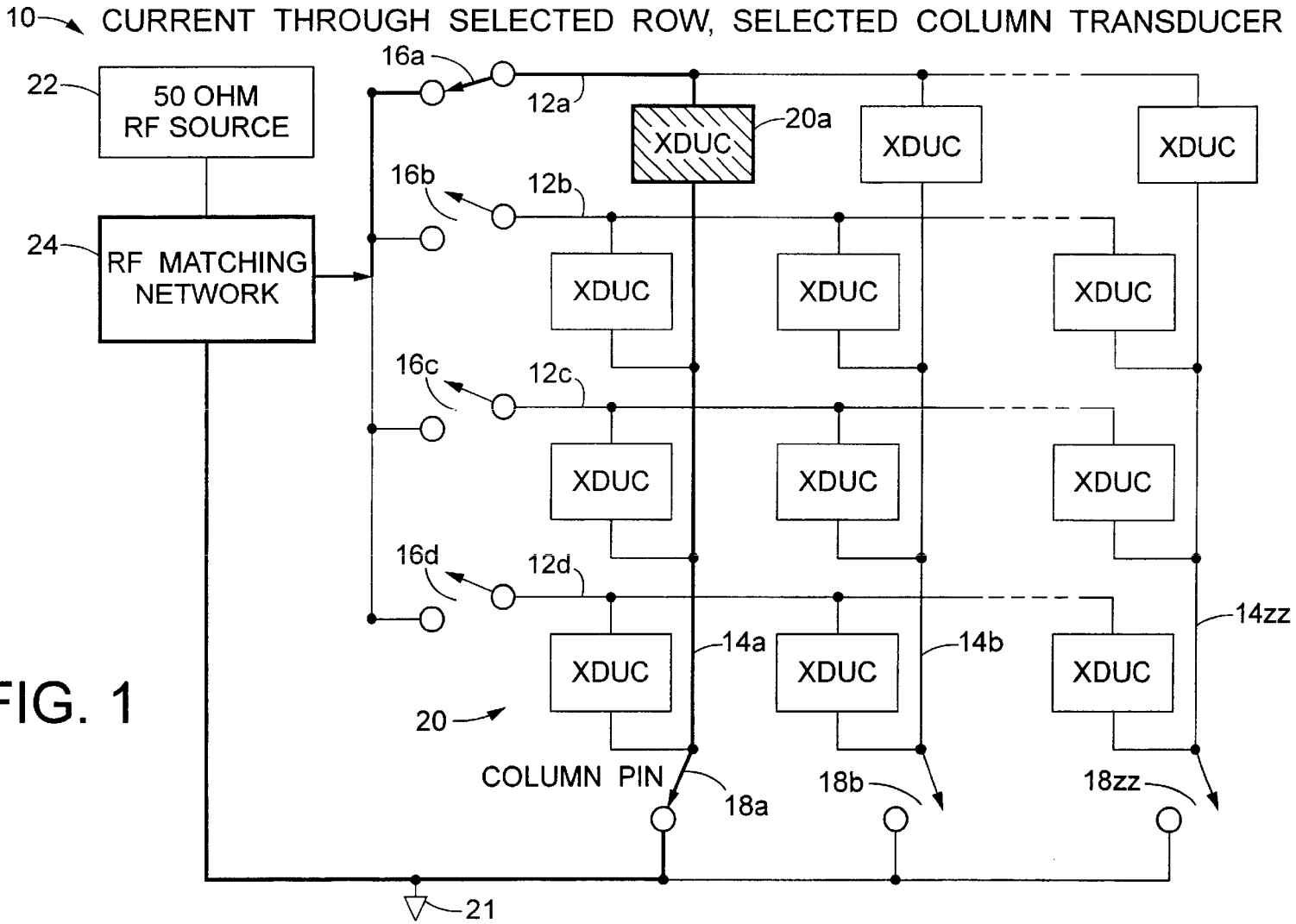
FIG. 1 illustrates an existing switching matrix for an AIP printhead.
Figure 11:
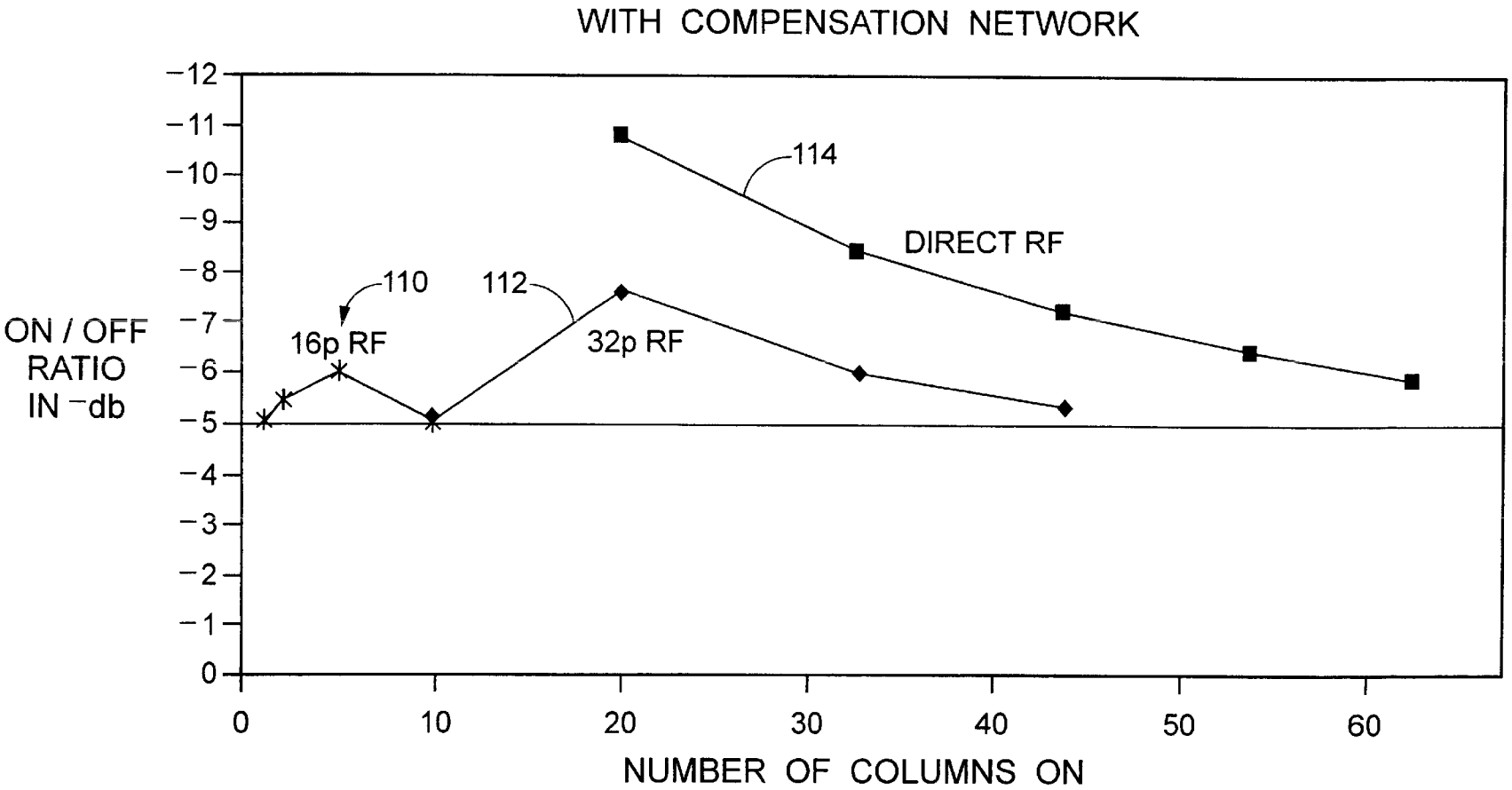
FIG. 11 is a graphical representation of the switching ratio of rows and columns of the matrix network.

FIG. 11 therefore, shows the switching ratios that can be achieved with different sources driving the column compensation bus and coupling capacitor 74. It may be understood by reviewing FIG. 1 that by having a selection of compensation options (i.e. 5 pico-farads to RF, 7 pico-farads to RF, 9 pico-farads to RF, etc.), it is possible to establish and maintain a switching ratio within a desired range, independent of the ratio of ON to OFF ejectors. It is also noted that it is necessary to take into consideration the characteristics of both transducers on the same column and transducers on the same row in order to maintain the switching ratio within a selected range over the entirety of the columns of the print head.

Of course, to implement this design, the compensation current is dynamically set to the proper values as image data changes. Particular compensation circuit designs are disclosed in U.S. patent application Ser. No. 09/447,316, entitled Printhead Array Compensation Device Designs, filed Nov. 22, 1999, commonly assigned and hereby incorporated by reference.

A variety of architectures which provide improved control of the switching ratio have been developed by the inventors, and will be discussed in following sections of this application. It is, however, appreciated that in a preferred implementation of a printhead having a low flow rate, such as in a phase-change acoustic printhead, there will be a significant rise in the temperature of the acoustic focal spot, for example anywhere between 5–20° C. Particularly, it is known that in acoustic printing, a focused beam is used to achieve drop ejection. This design causes local heating substantially at the point of the ink drop which is ejected. Therefore, the drop of ink which is expelled will have a substantially raised temperature.

A raised temperature at this location can be used to an advantage as a means to locally reduce the viscosity at the point of ejection, decreasing the required ejection energy, and increasing the maximum firing rate. While this temperature rise can be advantageous, the exact value of the ejection temperature will depend upon the acoustic power level being supplied to a particular transducer. As a result, ejectors which are ON (i.e. at a power level $P_{ON}$), will have a different acoustic focal temperature than those which are OFF (i.e. at a power level $P_{OFF}$). Since the focal heat spot equilibrates in temperature much more slowly than the ejection rate, this can lead to uncontrolled, data-dependent changes in the acoustic ejection process, giving rise to print quality degradation.

Figure 12:
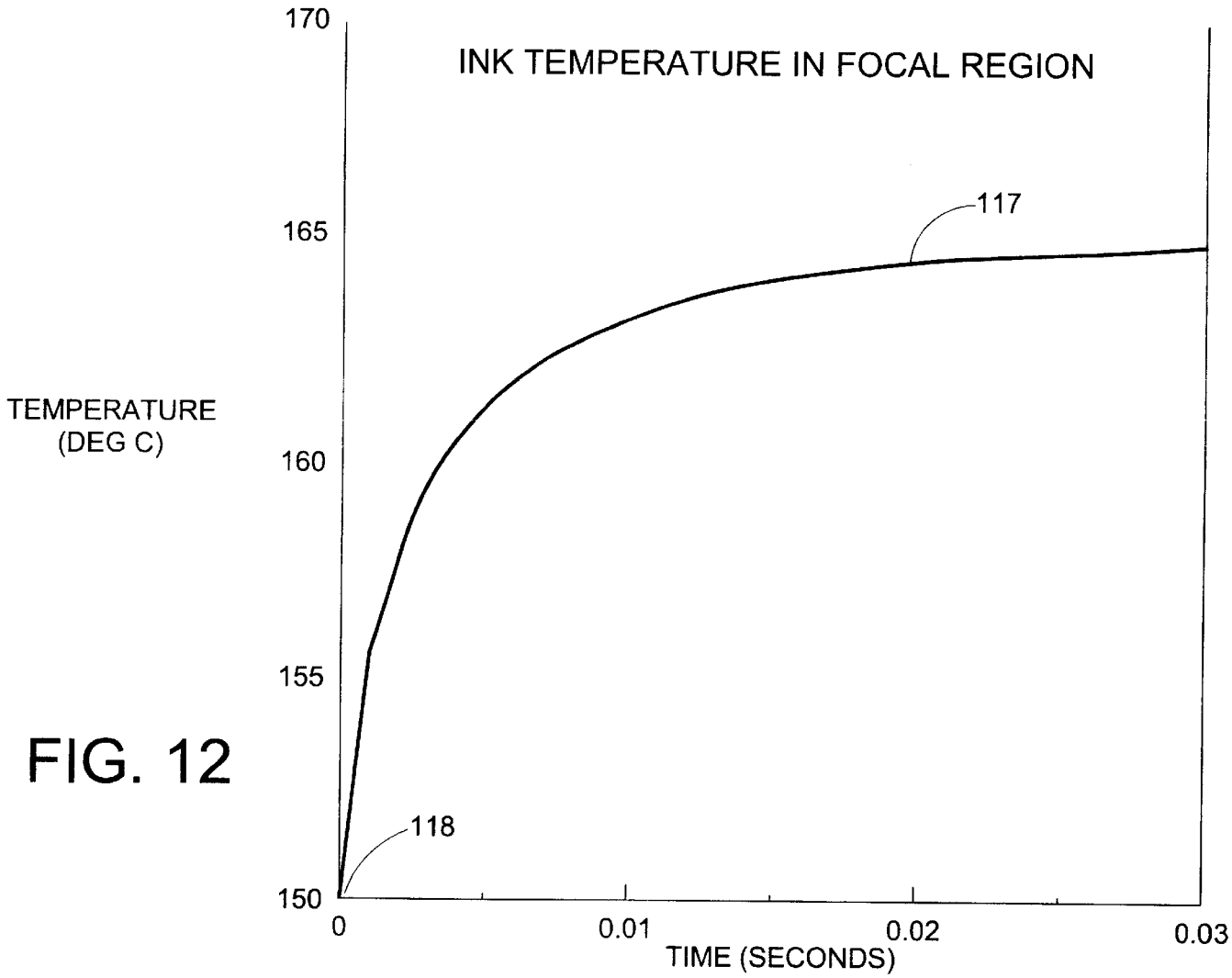
FIG. 12 is a graphical representation of ink temperature in a focal region over a preselected time period.

The problem is illustrated in FIG. 12, wherein the predicted temperature rise in the acoustic focal region is plotted as a function of time. At a firing rate of 14 kH, approximately 200 drops will be ejected by the time the focal region approaches thermal equilibrium at Time (T)=0.02 seconds 117. A presumed T=0, 118, condition is one in which no drops have been fired for a long period of time, and where the ON/OFF switching ratio is very high. The temperature rise shown in FIG. 12, approximately 10° C., is large enough to induce severe print non-uniformities. It was previously noted that a 1–2-degree C. change in temperature can result in an increase in drop diameter non-uniformity of 1–3%. To avoid print degradation, the physical energy and heat dissipation must be proximal to that of the ink drop being expelled.

Figure 13:
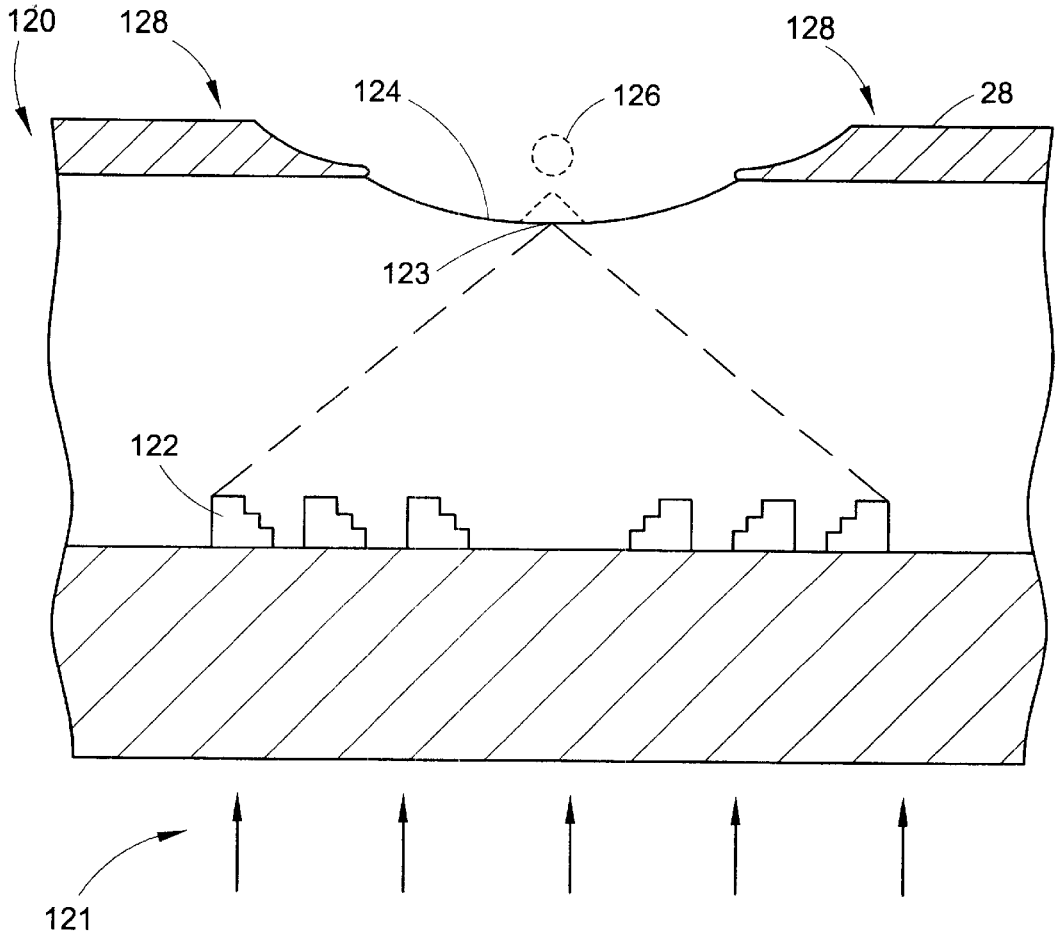
FIG. 13 is a simplified version of an acoustic ink print head ejecting an ink droplet.

As shown in FIG. 13, an acoustic printhead 120 is designed such that acoustic energy 121, generated by well known means, is focused by a lens 122, or other focusing device, to a focal point 123, which causes a pool of liquid 124 to expel a droplet 126. The focal point 123 is located in close physical proximity to the printhead surface 128. The detail of having a large amount of energy concentrated such that the heating of the printhead occurs near the ejected drop 126, means drop 126 will carry away a significant amount of heat energy. In this design, each droplet will carry away up to 50% or more of the heat at the focal point 123.

A further aspect of the present invention uses the dissipation of heat energy through expulsion of heated drop 126, in combination with the controlling of the switching ratio, to provide a precisely controlled balance in the power difference against the thermal energy which is carried away by the ejected droplet. The heat of the drop is equal to the density multiplied by the volume of the drop multiplied by the specific heat, multiplied by the firing rate of an ejector. Thus, the region of concentrated heat for which there is most concern about maintaining uniform temperature between ON and OFF, is immediately adjacent to the droplet which is carried away. Using this knowledge it is possible to select a specific switching ratio which will balance the ON and OFF states of the ejectors.

Figure 14:
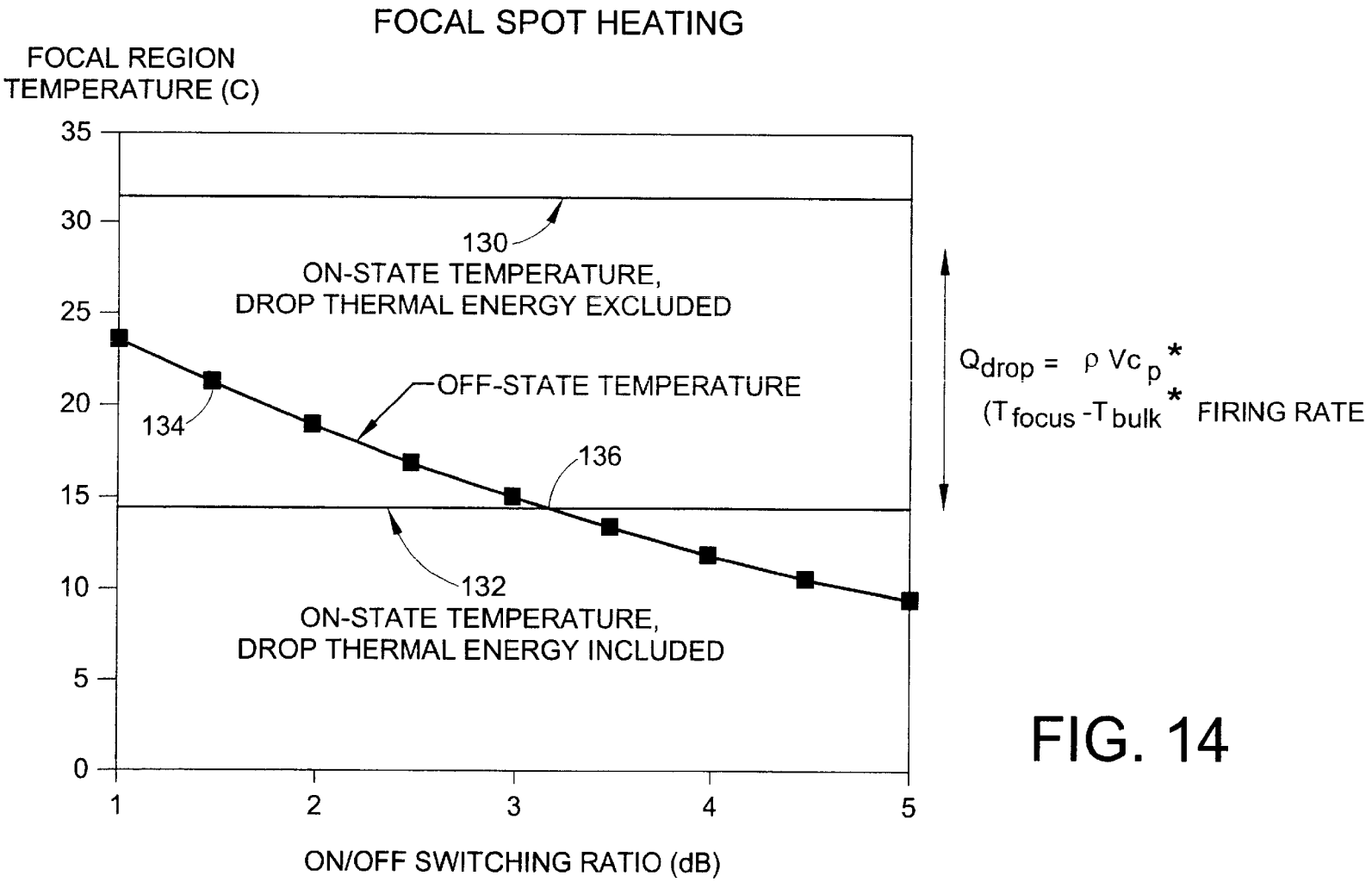
FIG. 14 is a graphical representation of focal heating which expels an ink droplet.

The heat loss occurring due to droplet ejection is to be included, when estimating a net temperature rise on the acoustic focal region. FIG. 14 shows two modeling results, one which includes the estimated heat temperature loss factor, and one without the inclusion of this heat temperature loss factor (this case is slightly different in detail than the values shown in FIG. 12). Modeled curve 130 shows the focal heating region is approximately 30° C. when the modeled temperature ON state does not take into consideration the thermal energy loss due to the ejected drop. Modeled curve 132 shows that the focal region temperature drops to slightly below 15° C., when the loss due to the ejection of the ejected drop is taken into consideration. Thus, the ejected drop is responsible for carrying away approximately 50% of the heat when the ejector is in an ON state.

Curve 134 illustrates the temperature rise in the OFF state (i.e. when no droplet is ejected) is simply the upper ON state representation 130, reduced by the amount of the switching ratio. Plotted in FIG. 14, is the predicted OFF state temperature for a range of switching ratios −1 to −5 dB. As seen by point 136 of FIG. 14, a switching ratio can be precisely chosen, as taught in FIGS. 9–11, such that the OFF-state temperature is equal to the ON-state temperature.

Thus, for an addressed row the OFF ejector should have the exact same switching ratio relative to an ON ejector so a correct amount of power is being dissipated in the entire row. The OFF ejectors are supplied with sufficient compensation current or energy to achieve this goal. When a next row is fired, it is desirable to have the preceding tow completely OFF, with as much switching ratio as possible (i-e not −5 dB's but closer to −20 dB's).

Figure 15:
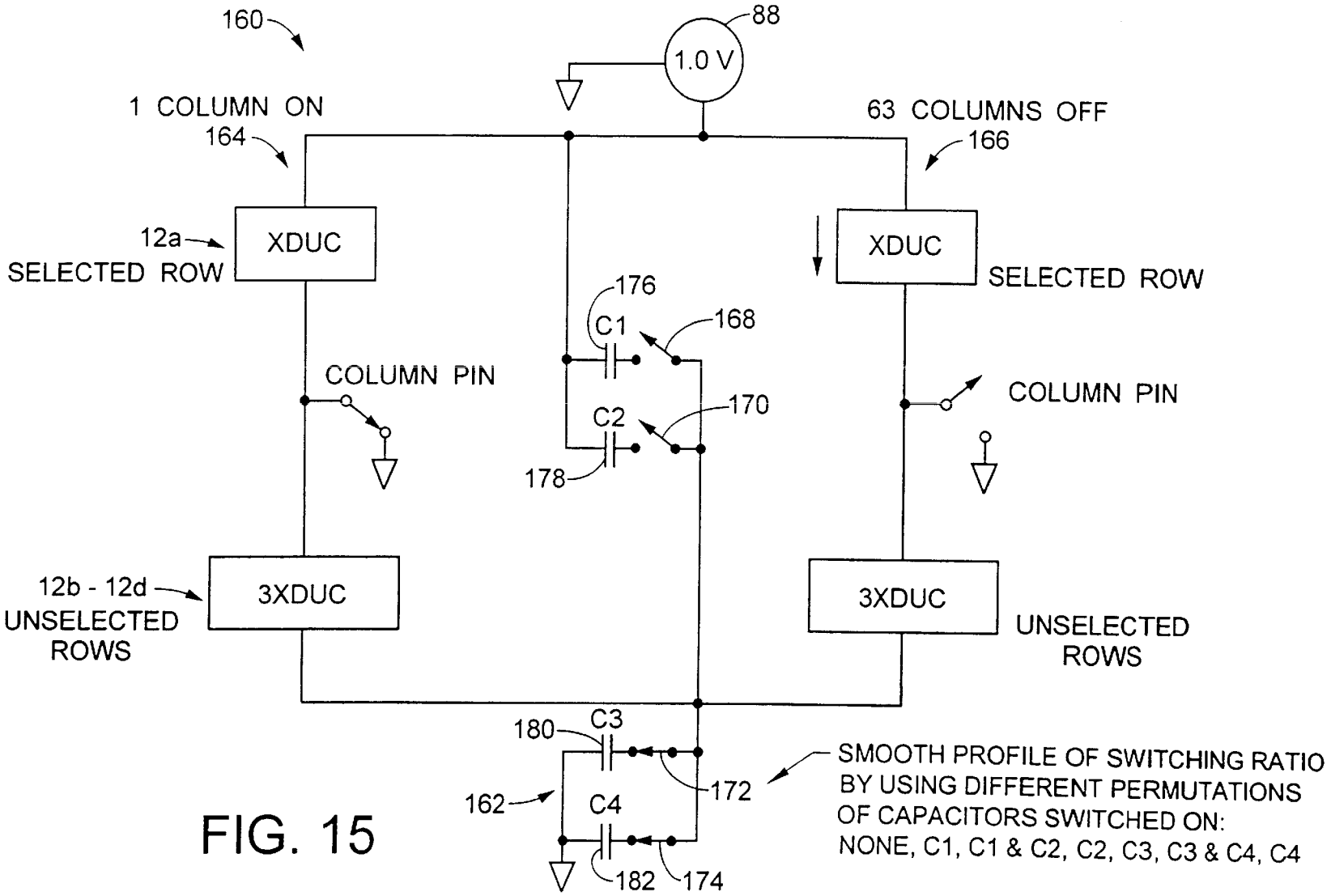
FIG. 15 illustrates row compensation for a 4-row, 64-column network where one column is ON, 63 columns are OFF, and one row is selected and three rows are not selected.

FIG. 15 depicts a 4-row, 64-column transducer switching matrix 160 which implements a row compensation network 162 according to the present invention. Row compensation is similar in function to column compensation in that adjustable compensation current paths are added around transducers that are located on unselected rows and/or columns, to modify the switching ratio as desired. The following example has one column ON 164 and 63 columns OFF 166, with row 12*a* selected while the remaining three rows 12*b*–12*d* are unselected. It is to be appreciated the invention will of course work with other ON/OFF ratios.

Row compensation network 162 includes a plurality of switches 168, 170, 172 and 174, which may be selectively coupled to corresponding capacitive elements 176, 178, 180 and 182. By selectively controlling operation of switches 168–174, it is possible to create a reasonably smooth profile of switching ratios by using different combinations of capacitors 176–182 to compensate unselected transducer rows. Specifically, the row compensation design will add compensation current paths to the transducers on unselected rows. The paths are to the RF source or to ground return in a manner similar to that shown for column compensation in FIG. 8. For example, in FIG. 15 switches 172 and 174 are closed to incorporate capacitors 180 and 182 into the switching network, and switches 168 and 170 are not selected. By this arrangement, compensation is provided to the unselected rows 12*b*–12*d* to obtain a desired switching ratio.

While four capacitive elements are shown for the compensation network 162, additional capacitive elements may be provided to generate a more refined control of the switching ratio. Further, although FIG. 15 has illustrated the concepts of the present embodiment with a single ON column and 63 columns OFF, the invention is intended to work with other ON/OFF ratios as well as with a matrix having more than 64 columns. Thus, row compensation network 160 selectively inserts capacitors 176, 178, 180 and 182 into a compensation configuration with the voltage supply 88 to thereby provide a compensation current.

Figure 16:
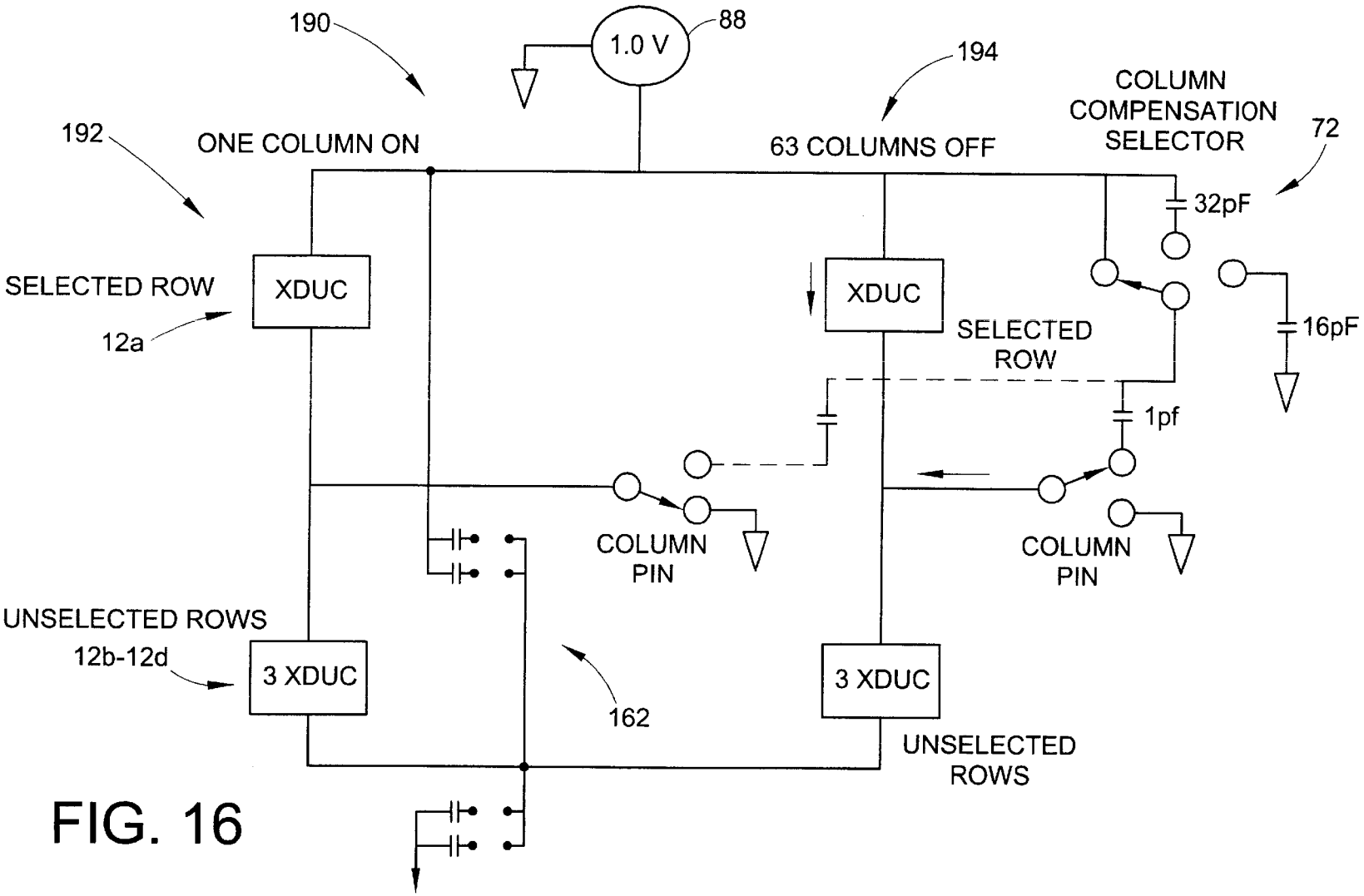
FIG. 16 depicts a simplified version of a dual compensation network including both row and column compensation for a 4-row, 64-column network with one column ON, 63 columns OFF, and one row is selected and three rows are not selected.

Turning to FIG. 16, illustrated is a transducer switching matrix 190 implementing both row compensation network 162 and column compensation network 72. Matrix 190 has a switching configuration of one column ON 192 and 63 columns OFF 194. Similar to previous examples, row 12*a* is selected and rows 12*b*–12*d* are unselected. Use of such an architecture allows for compensation to both currents in the rows of transducers and in the columns of transducers. Column compensation network 72 and row compensation network 162 will operate in a manner similar to that previously described in connection with architectures illustrating individual uses of these networks. By proper selection of compensation network components, it is possible to obtain and maintain a desired switching ratio.

Figure 2:
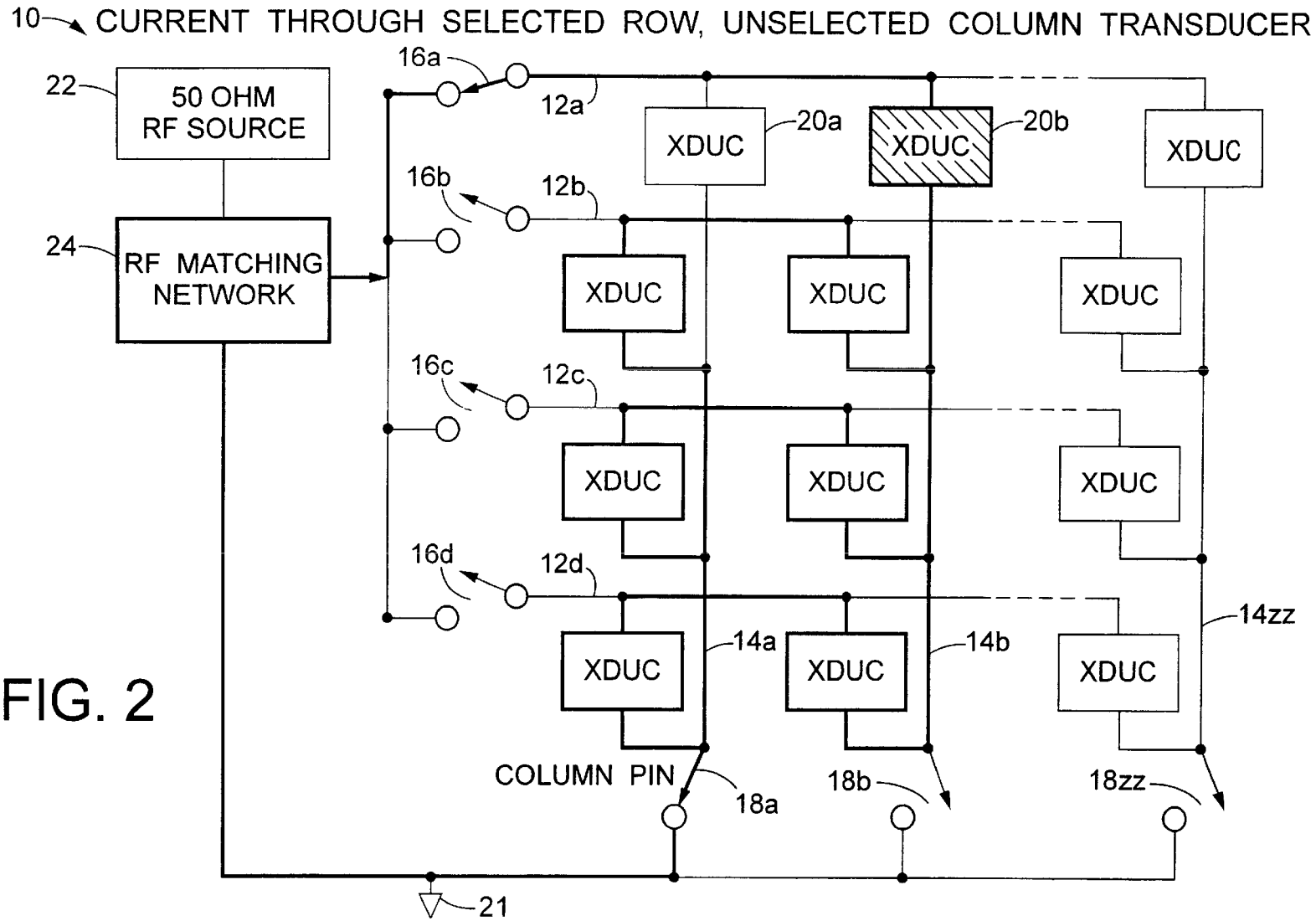
FIG. 2 depicts the matrix of FIG. 1 showing a concept of current leakage in a selected row, unselected column transducer situation.
Figure 3:
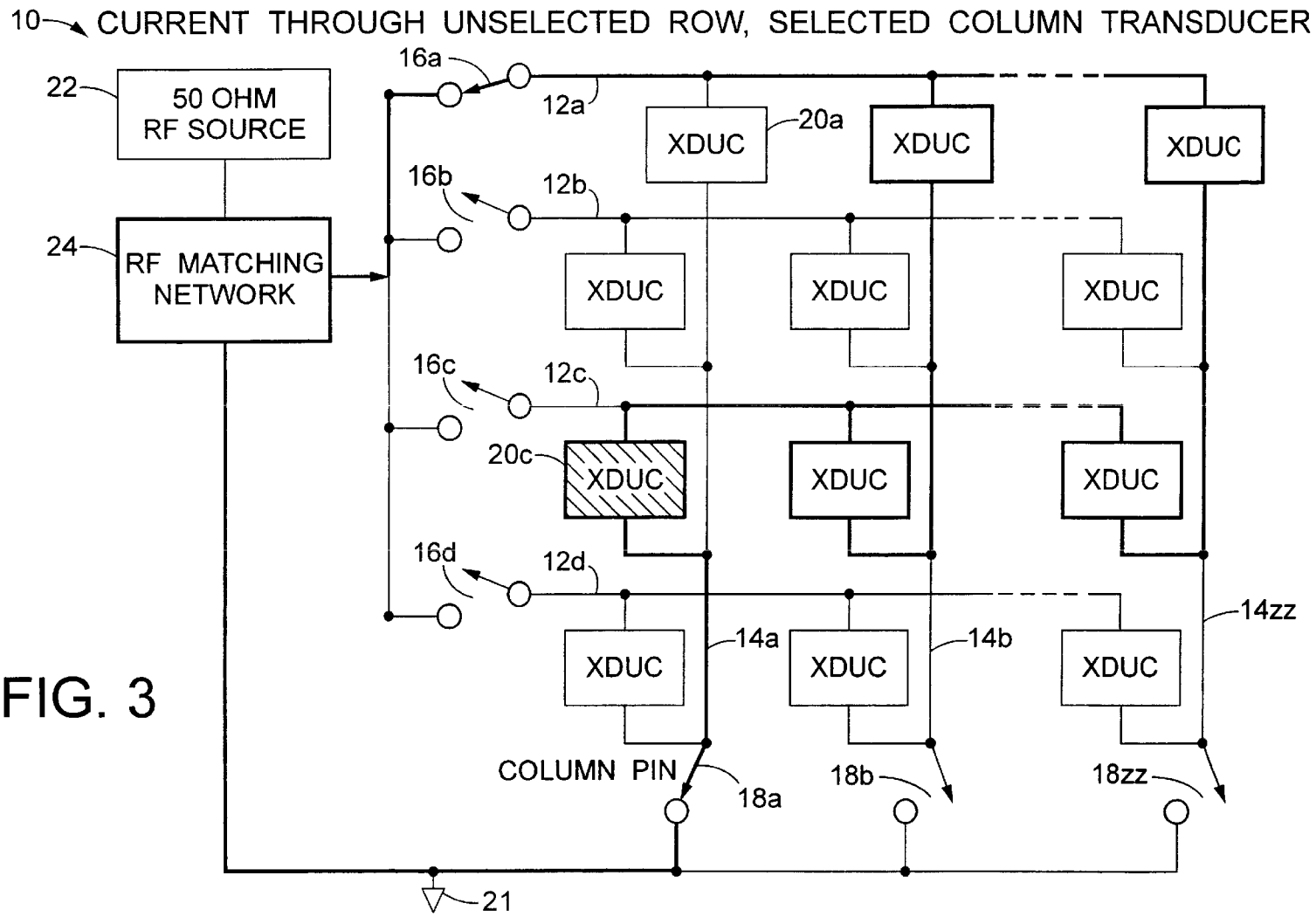
FIG. 3 shows a matrix of FIG. 1 in an unselected row, selected column transducer configuration.
Figure 17:
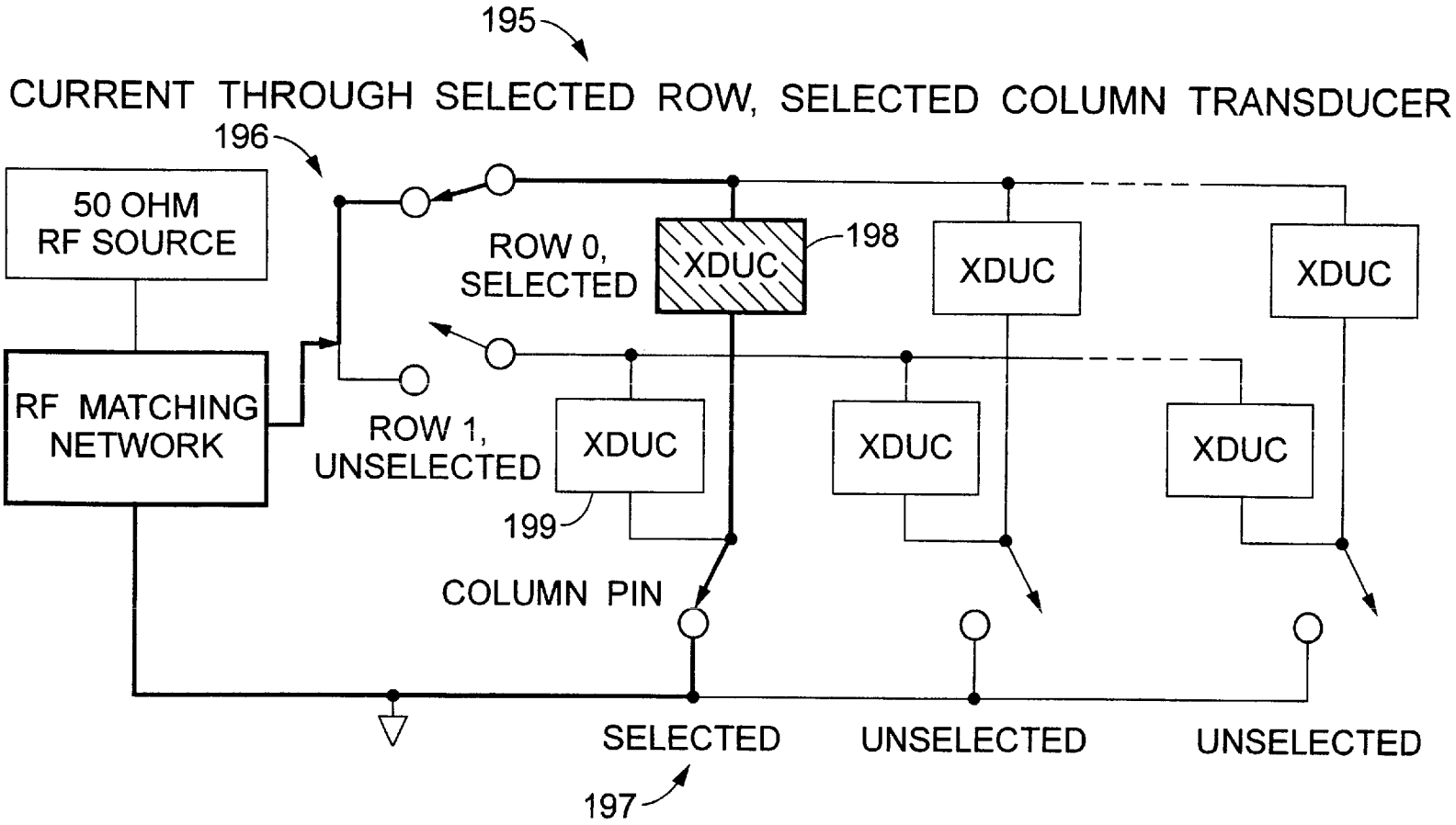
FIG. 17 illustrates a 2-row, 64-column switching network in which the present invention may be implemented.

FIG. 17 depicts a transducer switching network 196, comprised of 2 rows and 64 columns, although the network may employ more or less than 64 columns. As previously discussed, while using one column switch for several rows in parallel, reduces the number of column driver chips and wire bonds in a system, this approach results in increasing parasitic current paths which can limit the effective switching ratio for the RF column switches. The 2-row network 195 is implemented to improve the control of parasitic current paths. Network 195 functions under the same concepts as network 10 of FIGS. 1, 2 and 3. For example, a row 196, and column 197 are selected which allows a current to flow through transducer 198. However, similar to the discussion in connection with FIGS. 2 and 3, unwanted current paths will exist. This will result in undesirable current flow through OFF transducers, such as unselected transducer 199.

Figure 18:
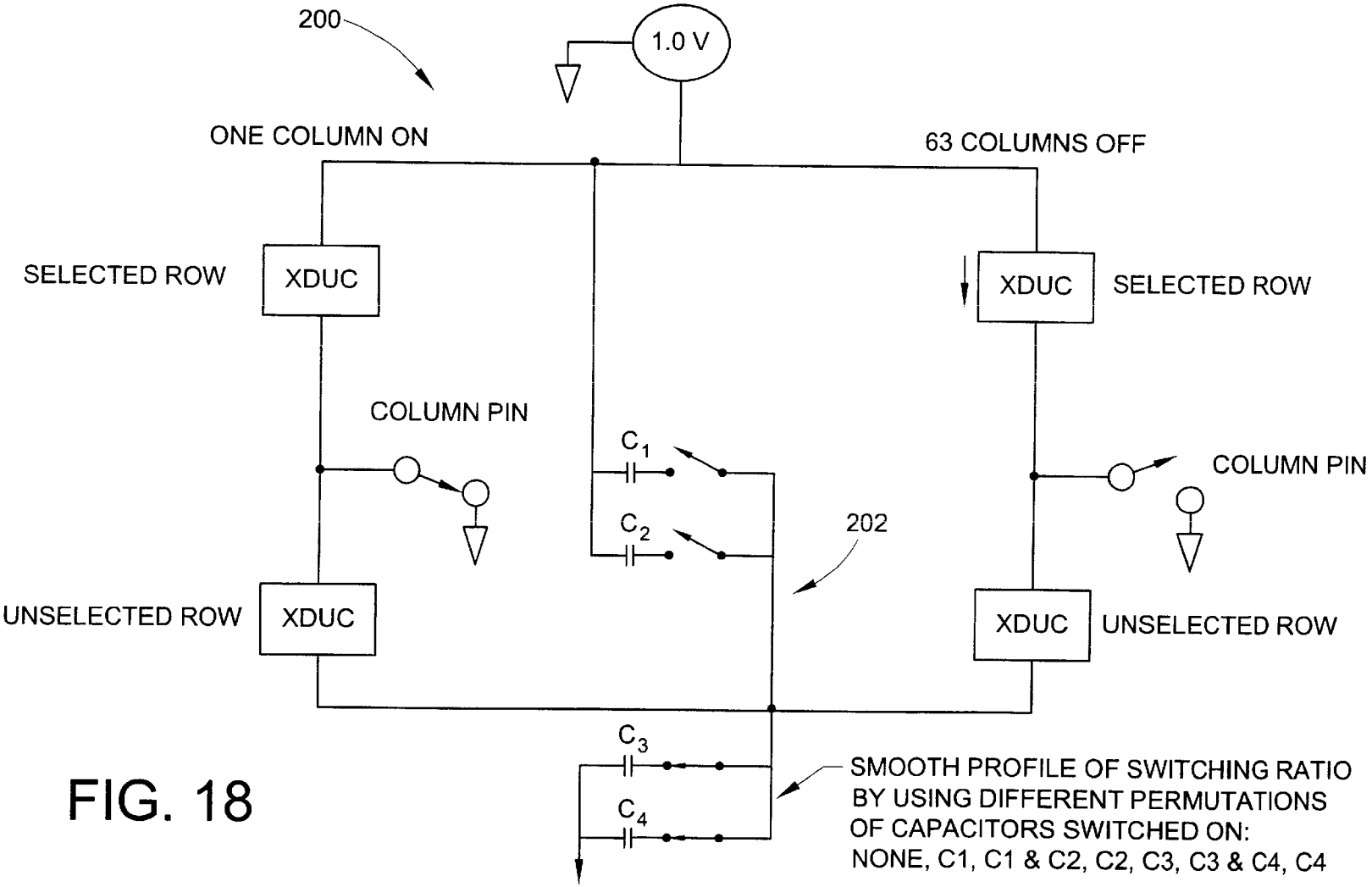
FIG. 18 depicts a simplified version of the 2-row, 64-column network having row compensation, where 63 columns are in an OFF state and one column is in an ON state.

Switching network 200 of FIG. 18 is a simplified illustration of switching matrix 195 shown in FIG. 17, further including a row compensation network 202 which conceptually operates in the same manner as row compensation network 162 of FIG. 15. A difference between compensation network 162 and compensation network 202, is found in that compensation network is required to only provide compensation for 2 rows. It is to be further understood that 2-row transducer switching matrix 195 may also be designed with a column compensation, such as column compensation network 72 of FIG. 10, as well as with both row and column compensation networks.

Using a 2-row transducer switching matrix achieves a reduction in the number of column driver chips and wire bonds compared to a system with a single row network, while also encountering less parasitic current paths than for transducer switching networks with 3 or more rows. The 2-row transducer switching matrix, which implements row and column current path compensation, is able to achieve highly reliable switching ratio control. It is to be appreciated that while capacitors have been described in the compensation networks, other devices such as diodes, transistors, etc. may be used to control compensation current paths and magnitudes. Further, the present embodiments have focused on 4 and 2-row column matrixes, however other size matrixes may also implement the present invention.

It is to be noted that the preceding discussion discussed the use of acoustic ink printers for the expulsion of ink droplets. It is, however, to be understood that the concepts of acoustic ink printing may be implemented in other environments other than two-dimensional image reproduction. These include the generation of three-dimensional images by droplet application, the provision of soldering, transmission of medicines, and other fluids.

The foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalence may be resorted to falling within the scope of the invention.

What is claimed is:

1. An acoustic printhead comprising:

a matrix of drop ejectors configured in rows and columns, each drop ejector including at least a transducer and a switch, wherein when a particular drop ejector is selected, the associated transducer and switch are turned on, and the transducer functions so as to cause the particular drop ejector to eject a drop from a pool of liquid, and when the particular drop ejector is not selected the associated transducer and switch are off, and the particular drop ejector does not eject a drop from the pool of liquid;

a plurality of row switches, connected to control operation of the rows of drop ejectors;

a plurality of column switches, connected to control operation of the columns of drop ejectors, wherein by selection of an appropriate row switch and column switch, the particular transducer of a specific drop ejector is turned on;

a controller connected to the plurality of row switches and the plurality of column switches, to control selection of the drop ejectors; and a compensation network connected to at least one of the rows of drop ejectors and columns of drop ejectors, wherein the compensation network selectively provides compensation energy to drop ejectors which are not selected, to lower undesirable current flow, the compensation network including, a row compensation network including a plurality of row compensation switches coupled to corresponding capacitive elements configured to create a smooth profile of switching ratios by selecting different combinations of capacitors to add compensation paths to transducers on unselected rows; and a column compensation network including a plurality of capacitive elements and a selection circuit configured to dynamically set compensation to a desired value.

2. The invention according to claim 1 wherein a single column switch, of the plurality of column switches, is connected to drop ejectors located in more than a single row of the array.

3. The invention according to claim 1 wherein the compensation network is configured to control a switching ratio of the matrix of drop ejectors, the switching ratio defined as the amount of power in a drop ejector which is off compared to the amount of power in a drop ejector which is on.

4. The invention according to claim 3, wherein control of the switching ratio includes improving the switching ratio of the acoustic printhead for a 4 row, 64 column drop ejector array to at least −5 dB.

5. The invention according to claim 1 wherein the compensation network is configured to inject a current into a switch of one of the unselected drop ejectors.

6. The invention according to claim 5 wherein the compensation network is configured to inject varying amounts of energy depending on a number of columns which are in an on state.

7. The invention according to claim 1 wherein each of the ejected drops remove heat energy from the acoustic printhead upon being ejected.

8. The invention according to claim 7 wherein a switching ratio is selected to balance power differences between on/off drop ejectors, against the thermal energy which is carried away by the ejected drop.

9. The invention according to claim 1 wherein the acoustic printhead is an acoustic ink printhead for emitting ink drops.

10. The invention according to claim 9 wherein the ink drops are phase change ink drops.

11. The invention according to claim 1 wherein the compensation network comprises at least one of:

a row compensation network including a plurality of row compensation switches coupled to corresponding capacitive elements configured to create a smooth profile of switching ratios by selecting different combinations of capacitors to add compensation paths to transducers on unselected rows; and a column compensation network including a plurality of capacitive elements, and a selection circuit configured to dynamically set compensation to a desired value.

12. The acoustic printhead according to claim 1 wherein the column switches are single pole double throw type switches, with alternative connections to one of the columns of drop ejectors and to the compensation network.

13. In an acoustic printhead having a matrix of drop ejectors configured in rows and columns to selectively eject drops from a pool of liquid, each drop ejector including at least a transducer and a switch, a plurality of the row switches connected to the rows of drop ejectors, a plurality of column switches connected to the columns of drop ejectors, and a controller to control selection on the drop ejectors, a method of ejecting drops, comprising:

selecting at least one particular drop ejector to eject a drop of liquid from the pool of liquid;

providing energy, from an energy source, to the particular drop ejector, wherein the transducer and the switch associated with the particular drop ejector are moved to an on state;

determining at least one other drop ejector, other than the particular ejector, is to be maintained in an off state while the particular ejector is provided with energy;

supplying the at least one other drop ejector with compensation energy to lower undesirable current flow in the matrix, wherein the supplying of compensation energy includes, providing a row compensation network including a plurality of row compensation switches coupled to corresponding capacitive elements, selecting different combinations of capacitors to add compensation paths to transducers on unselected rows to create a smooth profile of switching ratios, providing a column compensation network including a plurality of capacitive elements and a selection circuit, and dynamically setting the selection circuit to provide compensation at a desired value, and ejecting a drop from the pool of liquid.

14. The method according to claim 12 wherein the step of ejecting the drop of liquid from the pool includes removing heat energy, carried away by the ejected drop, from the acoustic printhead.

15. The method according to claim 12 wherein the step of supplying the at least one other drop ejector with the compensation energy, further includes determining an amount of compensation energy to be provided in order to obtain a desired switching ratio, the switching ratio being defined as the amount of power in a drop ejector which is off compared to the amount of power in a drop ejector which is on.

16. The method according to claim 14 wherein the step of determining the amount of compensating energy includes taking into account the amount of heat energy that is removed by the step of ejecting the ink drop, and the number of drop ejectors which are in an on state.

17. The method according to claim 15 further including a providing a varying amount of compensation energy to at least some of the drop ejectors which are in an off state, dependent upon the determining step.

18. The method according to claim 12 wherein the ejected drop is a drop of phase change ink.

19. An acoustic printhead comprising:

a matrix of drop ejectors configured in rows and columns, each drop ejector including at least a transducer and a switch, wherein when a particular drop ejector is selected, the associated transducer and switch are turned on, and the transducer functions so as to cause the particular drop ejector to eject a drop from a pool of liquid, and when the particular drop ejector is not selected the associated transducer and switch are off, and the particular drop ejector does not eject a drop from the pool of liquid;

a plurality of row switches, connected to control operation of the rows of drop ejectors;

a plurality of column switches, connected to control operation of the columns of drop ejectors, wherein by selection of an appropriate row switch and column switch, the particular transducer of a specific drop ejector is turned on;

a controller connected to the plurality of row switches and the plurality of column switches, to control selection of the drop ejectors; and a row compensation network connected to at least one of the rows of drop ejectors, the row compensation network including a plurality of row compensation switches coupled to corresponding capacitive elements configured to create a smooth profile of switching ratios by selecting different combinations of capacitors to add compensation paths to transducers on unselected rows, wherein the row compensation network selectively provides compensation energy to drop ejectors which are not selected, to lower undesirable current flow in the matrix.

20. The invention according to claim 18 wherein the matrix of drop ejectors includes two rows of the drop ejectors.

21. The invention according to claim 18 wherein the row compensation network generates variable compensation energy.

22. The invention according to claim 18 wherein the compensation network is configured to control a switching ratio of the matrix of drop ejectors, the switching ratio defined as the amount of power in a drop ejector which is off compared to the amount of power in a drop ejector which is on.

23. An acoustic printhead comprising:

a matrix of drop ejectors configured in rows and columns, each drop ejector including at least a transducer and an associated row switch and an associated column switch, wherein when a particular drop ejector is selected, the associated transducer and the associated row and column switches are turned on, and the transducer functions so as to cause the particular drop ejector to eject a drop from a pool of liquid, and when the particular drop ejector is not selected the associated transducer and the associated row and column switches are off, and the particular drop ejector does not eject a drop from the pool of liquid;

a plurality of the row switches, connected to control operation of the rows of drop ejectors;

a plurality of the column switches, connected to control operation of the columns of drop ejectors, wherein by selection of an appropriate row switch and column switch, the particular transducer of a specific drop ejector is turned on;

a controller connected to the plurality of row switches and the plurality of column switches, to control selection of the drop ejectors; and a compensation network connected to at least one of the rows of drop ejectors and columns of drop ejectors, wherein the compensation network includes at least one of, a row compensation network including a plurality of row compensation switches coupled to corresponding capacitive elements configured to create a smooth profile of switching ratios by selecting different combinations of capacitors to add compensation paths to transducers on unselected rows, and a column compensation network including a plurality of capacitive elements, and column compensation switches coupled to corresponding capacitive elements configured to create a smooth profile of switching ratios by selecting different combinations of capacitors to add compensation paths to transducers on unselected columns; and a selection circuit configured to dynamically set compensation to a desired value, wherein the compensation network selectively provides compensation energy to drop ejectors which are not selected, to lower undesirable current flow.

* * * * *